US010871161B2

(12) United States Patent
Valkenberg et al.

(10) Patent No.: US 10,871,161 B2
(45) Date of Patent: Dec. 22, 2020

(54) EPITROCHOIDAL VACUUM PUMP

(71) Applicant: Stackpole International Engineered Products, Ltd., Mississauga (CA)

(72) Inventors: Ralph Valkenberg, Stolberg (DE); Luke Bouwmeester, Aachen (DE)

(73) Assignee: STACKPOLE INTERNATIONAL ENGINEERED PRODUCTS, LTD., Ontario (CA)

( * ) Notice: Subject to any disclaimer, the term of this patent is extended or adjusted under 35 U.S.C. 154(b) by 327 days.

(21) Appl. No.: 15/946,994

(22) Filed: Apr. 6, 2018

(65) Prior Publication Data

US 2018/0291900 A1 Oct. 11, 2018

Related U.S. Application Data

(60) Provisional application No. 62/483,047, filed on Apr. 7, 2017.

(51) Int. Cl.
*F04C 29/02* (2006.01)
*F01C 21/08* (2006.01)
(Continued)

(52) U.S. Cl.
CPC ..... *F04C 25/02* (2013.01); *F04C 18/22* (2013.01); *F04C 29/02* (2013.01); *F01C 1/22* (2013.01);
(Continued)

(58) Field of Classification Search
CPC ..... F04C 25/02; F04C 18/22; F04C 29/02; F04C 29/0007; F04C 15/06; F04C 29/028; F01C 21/0872
See application file for complete search history.

(56) References Cited

U.S. PATENT DOCUMENTS 1,617,863 A 2/1927 Planche
1,636,486 A 7/1927 Planche
(Continued)

FOREIGN PATENT DOCUMENTS

DE 102012012723 A1 1/2013
EP 2647846 A1 10/2013
(Continued)

OTHER PUBLICATIONS

International Search Report dated Jul. 30, 2018 issued in corresponding International Application No. PCT/IB2018/052419.
(Continued)

*Primary Examiner* — Deming Wan
(74) *Attorney, Agent, or Firm* — Pillsbury Winthrop Shaw Pittman, LLP

(57) ABSTRACT

An epitrochoidal vacuum pump includes a housing having a chamber, a rotor rotatably received within the internal space of the chamber, and a drive shaft configured to rotate the rotor eccentrically about an axis within the chamber in an epitrochoidal manner. An externally toothed guide sprocket meshes with and guides movement of a guide gear of the rotor as it is driven by the drive shaft. A chamber inlet draws air under negative pressure into the housing, and an outlet is provided to expulse air under positive pressure from the housing. Further, a fluid inlet is provided to input lubricant along the drive shaft and into the internal space of the chamber. The fluid inlet is communicated by channel(s) in an interior of the housing. The lubricant is drawn into the housing via a pressure differential.

11 Claims, 30 Drawing Sheets

(51) Int. Cl.

| | |
|---|---|
| ***F04C 29/00*** | (2006.01) |
| ***F04C 25/02*** | (2006.01) |
| ***F04C 18/02*** | (2006.01) |
| ***F04C 18/22*** | (2006.01) |
| ***F04C 15/06*** | (2006.01) |
| *F01C 1/22* | (2006.01) |

(52) U.S. Cl.
CPC .. *F04C 2210/1005* (2013.01); *F04C 2220/10* (2013.01); *F04C 2240/20* (2013.01); *F04C 2240/30* (2013.01); *F04C 2250/20* (2013.01)

(56) References Cited

U.S. PATENT DOCUMENTS

| | | | | |
|---|---|---|---|---|
| 3,276,676 | A | 10/1966 | Buske | |
| 3,387,772 | A | 6/1968 | Wutz | |
| 3,549,110 | A | 12/1970 | Cotton | |
| 3,656,875 | A | 4/1972 | Luck | |
| 3,728,051 | A | 4/1973 | Humbert | |
| 3,881,847 | A | 5/1975 | Chen | |
| 3,899,272 | A | 8/1975 | Pratt | |
| 3,904,329 | A | 9/1975 | Steinwart | |
| 3,920,359 | A | 11/1975 | Gray | |
| 3,923,435 | A | 12/1975 | Jones | |
| 3,990,818 | A | 11/1976 | Loyd, Jr. | |
| 4,012,180 | A | 3/1977 | Berkowitz et al. | |
| 4,018,548 | A | 4/1977 | Berkowitz | |
| 4,025,245 | A | 5/1977 | Goloff | |
| 4,028,021 | A | 6/1977 | Berkowitz | |
| 4,043,714 | A | 8/1977 | Berkowitz | |
| 4,047,856 | A | 9/1977 | Hoffman | |
| 4,061,445 | A | 12/1977 | Doshi | |
| 4,072,210 | A | 2/1978 | Chien | |
| 4,105,375 | A | 8/1978 | Schindelhauer | |
| 4,116,593 | A | 9/1978 | Jones | |
| 4,118,157 | A | 10/1978 | Mayer | |
| 4,137,024 | A | 1/1979 | Jones | |
| 4,150,926 | A | 4/1979 | Eiermann | |
| 4,218,199 | A | 8/1980 | Eirmann | |
| 4,278,409 | A | 7/1981 | Eiermann | |
| 4,330,240 | A | 5/1982 | Eslinger | |
| 4,389,172 | A * | 6/1983 | Griffith | F01C 1/22 418/61.2 |
| 4,395,206 | A | 7/1983 | Hoffmann | |
| 4,507,066 | A | 3/1985 | Duffy | |
| 4,551,073 | A | 11/1985 | Schwab | |
| 4,594,060 | A | 6/1986 | Schwab | |
| 4,936,761 | A * | 6/1990 | Hasegaki | F01C 21/0872 418/84 |
| 5,046,932 | A | 9/1991 | Hoffmann | |
| 5,391,067 | A | 2/1995 | Saunders | |
| 5,431,551 | A | 7/1995 | Aquino et al. | |
| 5,944,499 | A | 8/1999 | Morita | |
| 6,014,791 | A | 1/2000 | Nosenchuck | |
| 6,106,250 | A | 8/2000 | Morita et al. | |
| 6,158,992 | A | 12/2000 | Morita | |
| 6,164,945 | A | 12/2000 | Ishibashi et al. | |
| 6,168,405 | B1 | 1/2001 | Nosenchuck | |
| 6,241,490 | B1 | 6/2001 | Rippl | |
| 6,520,754 | B2 * | 2/2003 | Randolphi | F04C 18/22 417/410.3 |
| 6,786,128 | B1 | 9/2004 | Gaudet | |
| 6,799,955 | B1 | 10/2004 | Sbarounis | |
| 6,886,528 | B2 | 5/2005 | James | |
| 7,549,850 | B2 | 6/2009 | Trapalis | |
| 7,789,634 | B2 | 9/2010 | Higashi et al. | |
| 8,749,079 | B1 | 6/2014 | Dunn et al. | |
| 8,753,099 | B2 | 6/2014 | Holtzapple et al. | |
| 8,920,147 | B2 | 12/2014 | Guenther | |
| 9,091,169 | B2 | 7/2015 | Guenther | |
| 9,303,641 | B2 | 4/2016 | Hilpert et al. | |
| 9,511,186 | B1 | 12/2016 | Nystrom | |
| 10,001,123 | B2 | 6/2018 | Kreuger | |
| 10,087,758 | B2 | 10/2018 | Montie et al. | |
| 10,550,842 | B2 * | 2/2020 | Garside | F04C 27/02 |
| 2004/0126262 | A1 * | 7/2004 | Matsuura | F04C 28/06 418/93 |
| 2006/0083651 | A1 | 4/2006 | Lim | |
| 2012/0301343 | A1 * | 11/2012 | Satou | F04C 28/24 418/84 |
| 2015/0152867 | A1 | 6/2015 | Fleger et al. | |
| 2017/0204857 | A1 | 7/2017 | Garside | |
| 2017/0241416 | A1 | 8/2017 | Yamamoto et al. | |
| 2017/0362974 | A1 | 12/2017 | Schulz et al. | |
| 2018/0291900 | A1 | 10/2018 | Valkenberg et al. | |

FOREIGN PATENT DOCUMENTS

| | | | |
|---|---|---|---|
| GB | 557902 | A | 12/1943 |
| WO | 00/37784 | A1 | 6/2000 |
| WO | 2016/009197 | A1 | 1/2016 |

OTHER PUBLICATIONS

Written Opinion of the International Searching Authority dated Jul. 30, 2018 issued in corresponding International Application No. PCT/IB2018/052419.

International Preliminary Report on Patentability dated Oct. 8, 2019 issued in corresponding International Patent Application No. PCT/IB2018/052419, (5 pgs.).

* cited by examiner

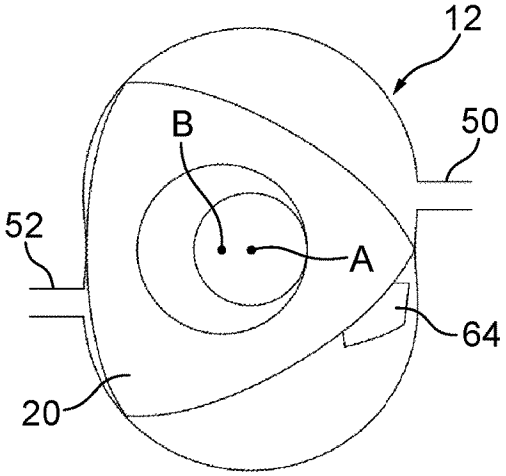
FIG. 21
FIG. 22
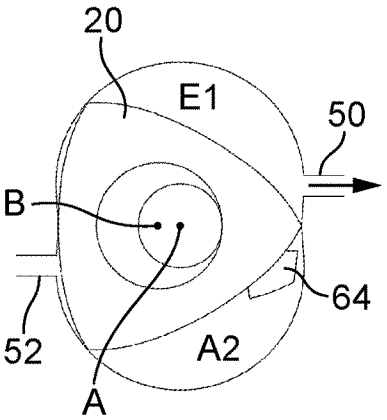
FIG. 23
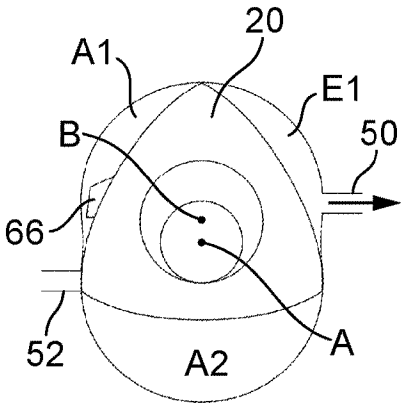
FIG. 24
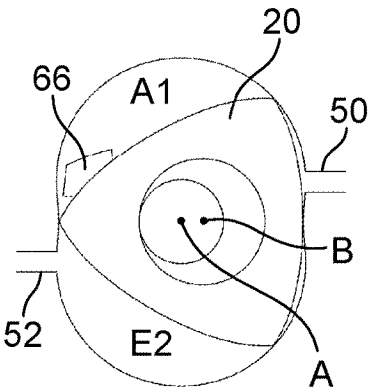
FIG. 25

EPITROCHOIDAL VACUUM PUMP

CROSS REFERENCE TO RELATED APPLICATION

This application claims priority to U.S. Provisional Patent Application No. 62/483,047, filed Apr. 7, 2017, which is hereby incorporated by reference in its entirety.

BACKGROUND

Field

The present invention is generally related to a vacuum pump with an epitrochoidal rotating design.

Description of Related Art

Wankel engines include an eccentrically rotated rotor, having three sides, that is moved within a chamber. As it is rotated, the rotor minimizes volume of the combustion chamber and maximizes compression. Its four stage cycle of intake, compression, ignition, and exhaust produces one power stroke per rotor orbital revolution.

Some vacuum pumps are known to use a polygonal-shaped rotor, like those in Wankel engines, that eccentrically rotates within a chamber. In such cases, however, the chamber tends to include curved lobes within its compartment. This is so that a reduced pressure may be generated within the lobes of the compartment as the rotor rotates. Moreover, such vacuum pumps are typically "dry" in that they use air as their only input.

U.S. Patent Publication No. 2017/0204857 discloses a prior attempt at an epitrochoidal design for a compressor or vacuum. It has the shortcoming of being overly complicated to manufacture, and has an impractical approach to managing lubricant delivery that makes it unsuitable for automotive and other applications associated with engines or where package space is restricted.

SUMMARY

It is an aspect of this disclosure to provide an epitrochoidal vacuum pump that includes: a housing having a chamber having an internal space defined by a surrounding wall flanked by a front wall and a back wall, the internal space having an epitrochoidal shape; a rotor rotatably received within the internal space of the chamber, the rotor being shaped with a number of edges that conjugate with the epitrochoidal shape of the internal space and including an internally toothed guide gear; a drive shaft configured to rotate the rotor eccentrically about an axis within the chamber; an externally toothed guide sprocket for meshing with and guiding movement of the guide gear of the rotor as it is driven by the drive shaft; at least one chamber inlet for drawing air under negative pressure into the housing; and at least one outlet for expulsing air under positive pressure from the housing. In addition, a fluid inlet for inputting lubricant is provided. The fluid inlet is communicated to both a drive shaft channel for leading the lubricant to the drive shaft for lubrication thereof and a chamber channel for leading the lubricant to the internal space of the housing chamber. The drive shaft channel and the chamber channel are subject to a pressure differential generated in the internal space for drawing the lubricant through the fluid inlet and the channels.

Other features and advantages of the present invention will become apparent from the following detailed description, the accompanying drawings, and the appended claims.

BRIEF DESCRIPTION OF THE DRAWINGS

FIG. 21 is a schematic view of the parts of the vacuum pump of FIG. 1, showing positioning of inlets and outlets in the housing.

FIGS. 22-25 illustrate steps of a cycle as the rotor performs a single revolution in the vacuum pump of FIG. 1.

DETAILED DESCRIPTION

Figure 1:
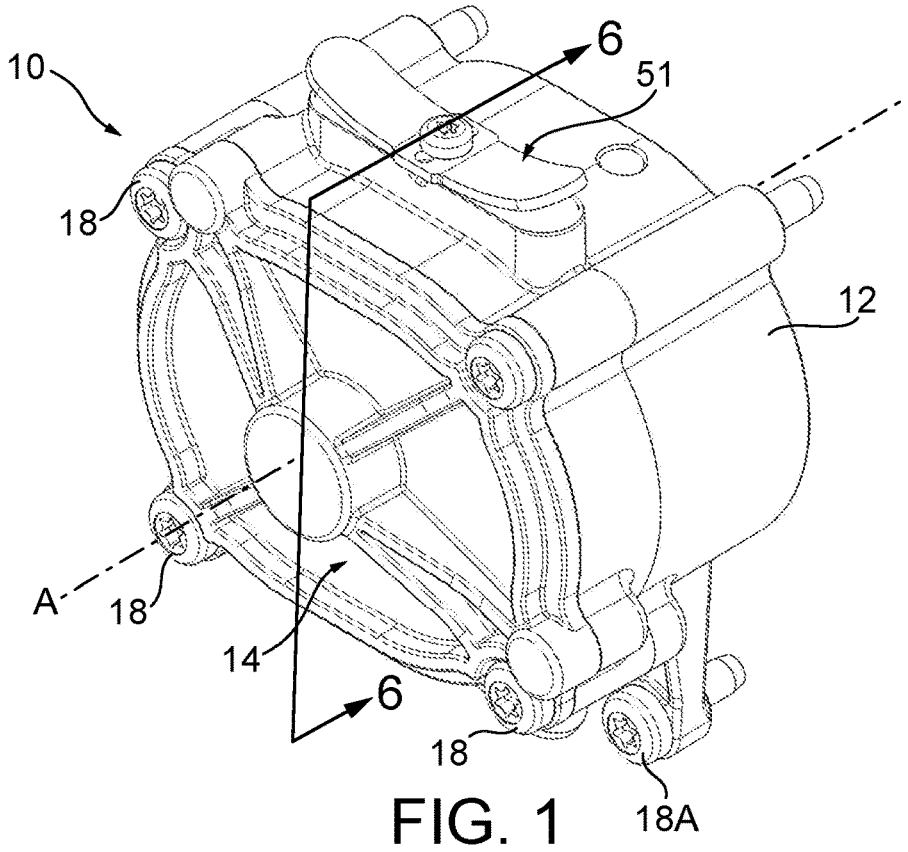
FIGS. 1 and 2 are isometric views of a front and a back, respectively, of a vacuum pump in accordance with an embodiment of this disclosure.

A vacuum pump having an epitrochoidal rotating group design is described herein. An epitrochoid is defined as a geometric curve or plane curve that is generated by tracing motion of a fixed point on the radius (or extended radius) of a circle as it rolls on the outside/external portion of a fixed, base circle. As shown in the drawings and understood by the description herein, the herein disclosed vacuum pump designs produce epitrochoidal-like rotation of its rotor within the housing. As understood by one of ordinary skill in the art, the shape of the inner envelope of the epitrochoid (which is the basis for the shape of the housing in which the rotor rotates) determines or aids in generating the shape of the rotor (i.e., the shape of the outer edges or lobes of the rotor).

The disclosed epitrochoidal vacuum pumps described herein each utilize relationships, features, and functions as defined by the epitrochoidal features. Although the rotors in the described exemplary embodiments may take different shapes or forms (e.g., two lobed sides or three lobed sides), the concepts and features relating to each of the vacuum pumps as a result of using a chamber with an epitrochoidal shape for the rotor do not change.

The drive ratio between the gears is dictated by the type of epitrochoid design used (e.g., three lobe rotor, two lobe rotor). The parameter Z in the generating equation for an epitrochoid defines the relationship between the two generating circles and dictates the resulting amount of lobes for a rotor made from the inner envelope of the epitrochoid. The Z parameter is the number of cycles the outer circle rotates while revolving around the inner circle to generate the epitrochoid shape. The Z parameter is calculated by the formula a+b/b where a is the radius of the fixed inner circle used to plot the epitrochoid and b is the radius of the outer circle that revolves and rolls about the inner circle. The gear ratio used to guide the rotor correctly is defined as (Z−1)/Z.

As previously noted, it is understood by one of ordinary skill in the art that each combustion chamber in a traditional four stroke Wankel engine generates one combustion stroke per driveshaft rotation; i.e., one power stroke per rotor orbital revolution. In accordance with some embodiments, this disclosure utilizes and improves upon such principles of the Wankel engine within a vacuum pump. Specifically, one embodiment relates to a vacuum pump having a rotor that is instead designed to produce two working strokes per rotor orbital revolution (a "working stroke" refers to a power stroke).

In one exemplary embodiment, this is achieved by removing the combustion function of the Wankel design and adding an extra inlet and outlet, along with a lobed rotor. That is, as described in greater detail below, a three lobed rotor, two chamber inlets and four outlets are provided in a housing 12 of a vacuum pump 10. In another exemplary embodiment, a two lobed rotor, one inlet and one outlet are provided in a housing 12A of a vacuum pump 10A. As understood by one of ordinary skill in the art, each of the disclosed embodiments of vacuum pumps may be configured for connection to an oil pump.

Figure 9:
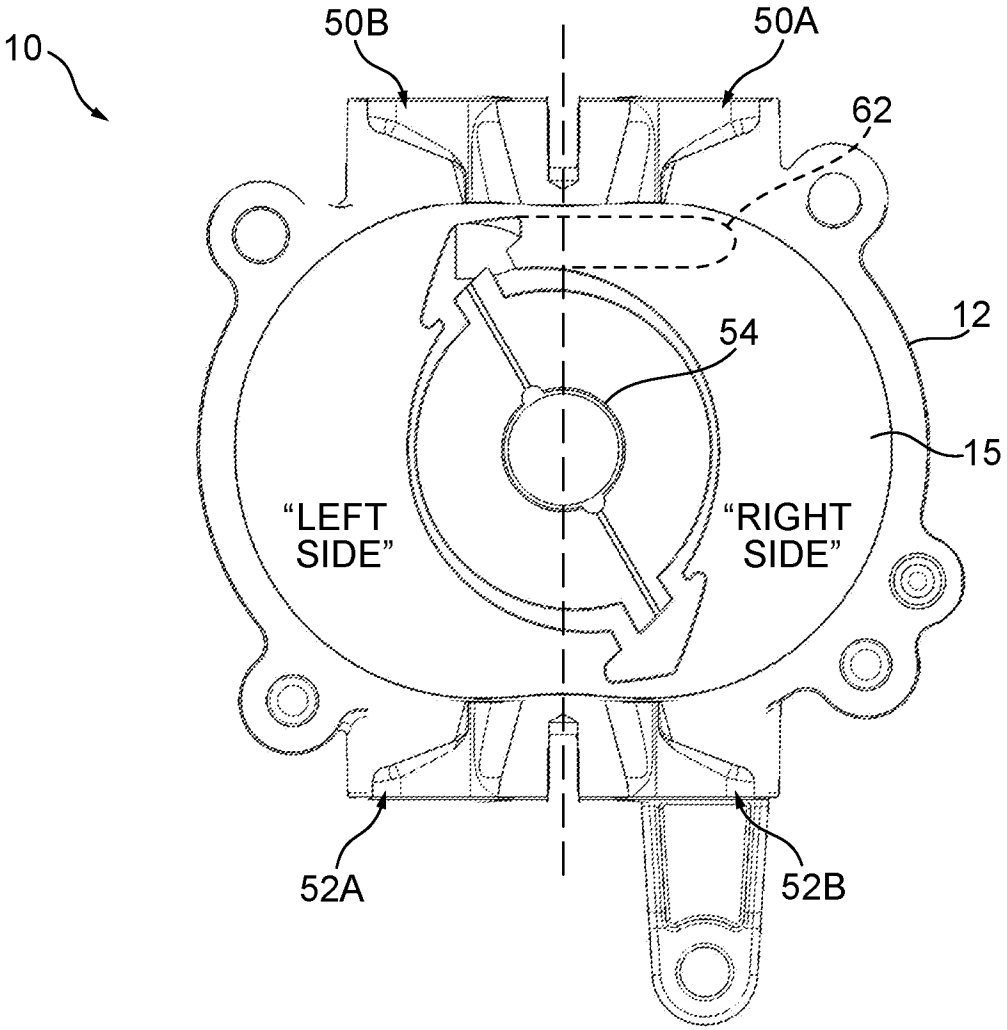
FIGS. 9 and 10 are a front view and a back view, respectively, of part of the housing of the vacuum pump of FIG. 1 showing pump outlets and passageways for oil and air.

Turning now to the illustrative embodiment of FIGS. 1-31, two working chambers are implemented in the housing 12 (e.g., one left, one right) of the disclosed vacuum pump 10 (see, e.g., FIG. 9, showing an example of left and right chambers, which may be interchangeable depending on the positioning of the pump). Each working chamber has a chamber volume. For each rotor revolution, each chamber fulfills three evacuation cycles. Accordingly, the total evacuation capacity per pump shaft rotation in the disclosed vacuum pump 10 is defined as: single chamber volume×2 (since there are two chambers)×3 (evacuation cycles per rotor revolution)/3 (rotor speed reduction to shaft speed); therefore, the total evacuated capacity is 2*single chamber volume.

In vacuum pump 10, the gear ratio of the guide gear to the rotor gear is 2/3.

The disclosed vacuum pump 10 of FIGS. 1-31 also has internal channels machined into the housing 12 designed to feed or draw lubricant (e.g., oil) from its drive shaft and into air inlets such that the lubricant is sucked or pulled into the chamber as it expands. The vacuum pump rotor speed is reduced by factor 1/3 as compared to shaft speed.

As understood by one of ordinary skill in the art, the rotor speed, length and mass are relevant for the load on the rotor tips. The load on the rotor tips is the restricting parameter for the pump speed due to wear. For identical radial dimensions, the herein disclosed epitrochoidal pump 10 provides a relative tip speed that is reduced by more than 60% as compared to a standard single vane pump (drive ratio is 1/3 of rotor to drive shaft). In addition, the rotor of pump 10 is guided by the excenter, and only the mass of the moveable vane tips plus any applicable spring force create vane tip load. Due to these two parameters, the speed of the drive shaft can be increased by more than 50% compared to a typical vane pump. As such, the disclosed pump 10 provides the opportunity to propose a number of applications, from a sump vacuum pump for gasoline engines up to high speed applications.

Figure 2:
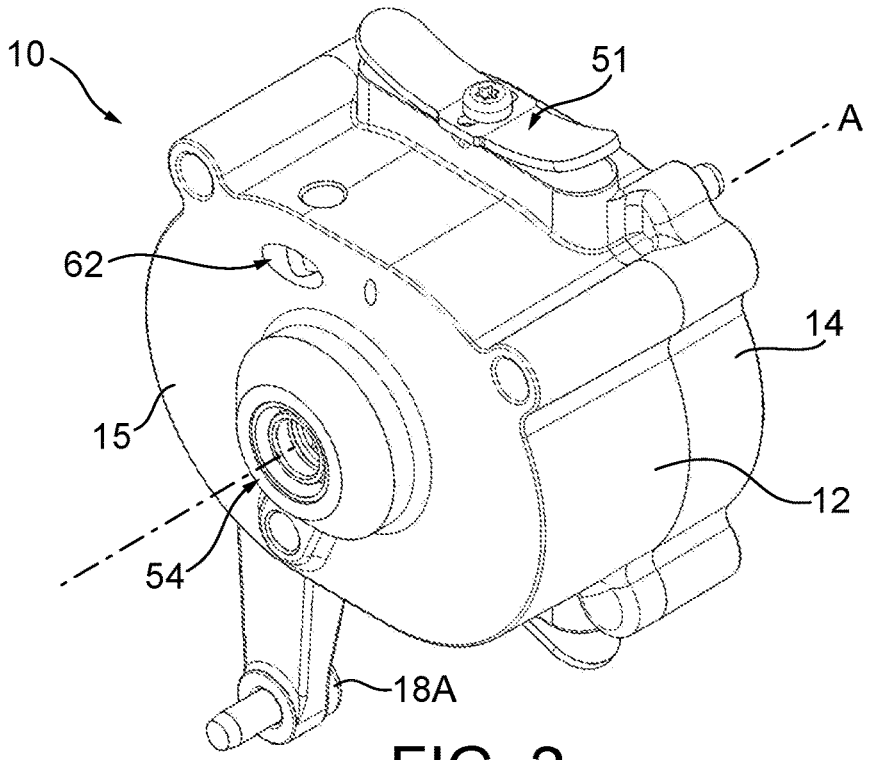
Figure 3:
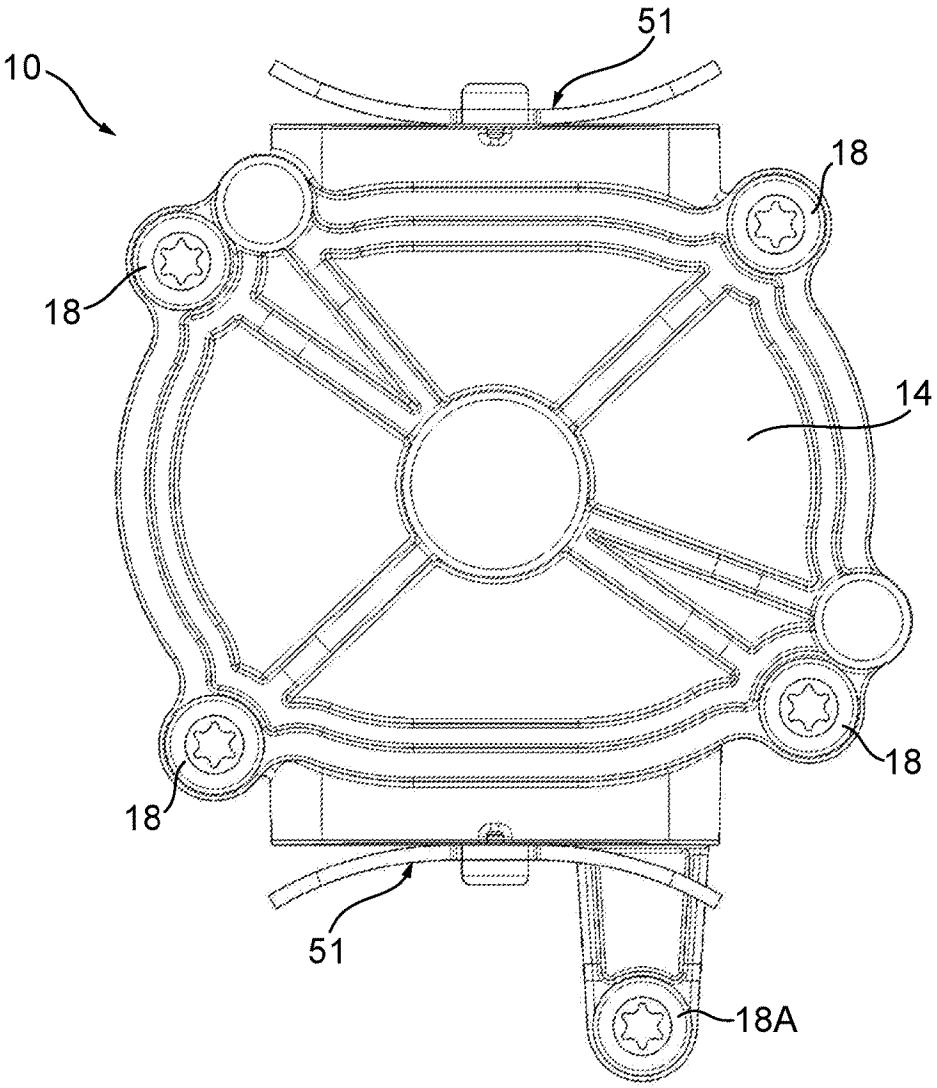
FIG. 3 it a front view of the vacuum pump of FIG. 1.

FIGS. 1-3 show a front and a back of a vacuum pump 10, in accordance with an embodiment of this disclosure. FIGS. 4, 5, 12 and 13, show an overview of parts inside the vacuum pump 10. FIGS. 6-11 illustrate alternative views of the vacuum pump 10 and its different parts. In accordance with one embodiment, vacuum pump 10 is a "wet" vacuum pump, i.e., a pump that intakes air for pressurization and also receives/intakes a small amount of lubricant or oil into its housing 12. The lubricant is added to the housing 12 via feed channels 56, 58 (see FIG. 11) for various purposes, e.g., to seal vacuum chambers at apices of its rotor 20 as it is rotated therein, which are described in greater detail later.

Figure 4:
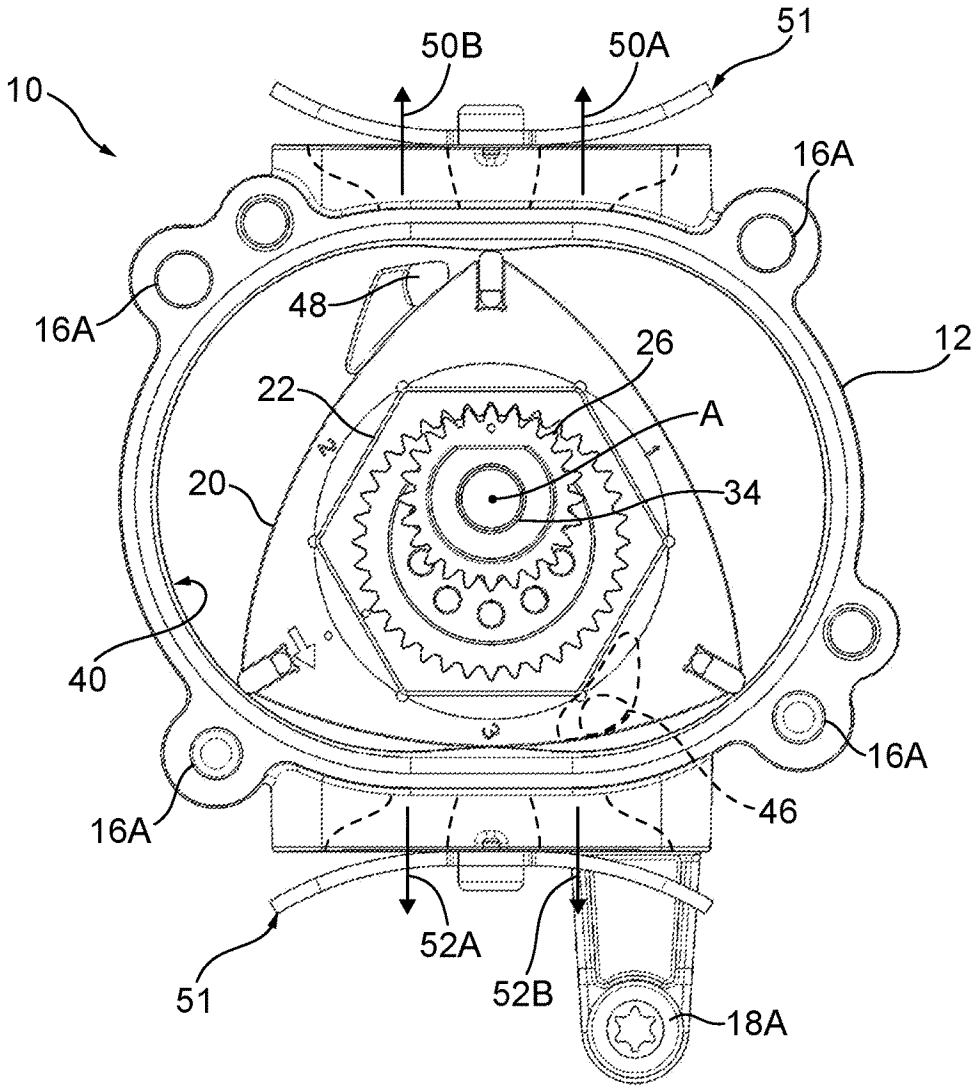
FIG. 4 is a schematic front view of the vacuum pump of FIGS. 1-3, with the cover removed, showing parts provided in its housing, in accordance with an embodiment of this disclosure.
Figure 12:
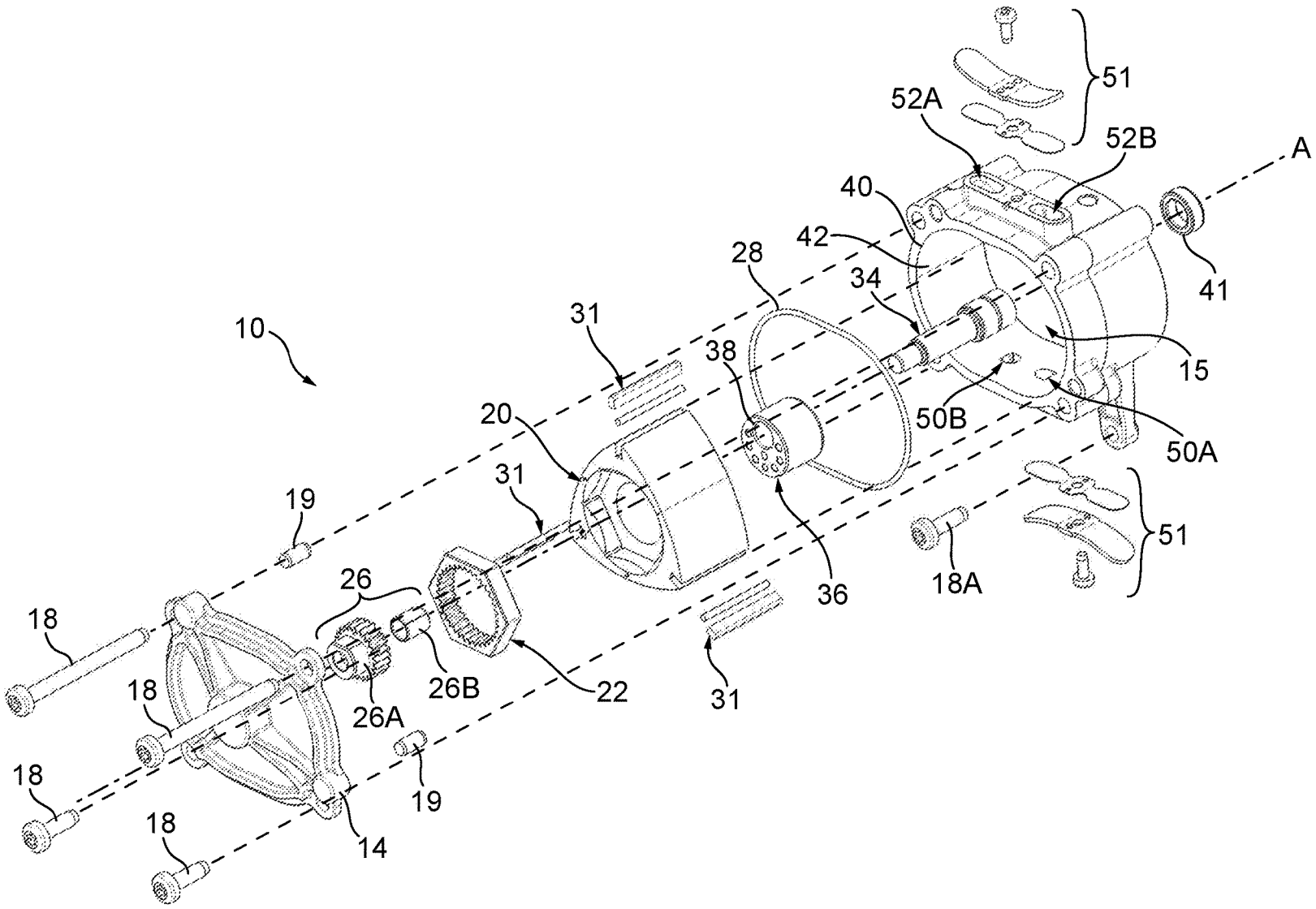
FIG. 12 shows an exploded view of the parts of the herein disclosed vacuum pump of FIG. 1 in accordance with an embodiment.
Figure 13:
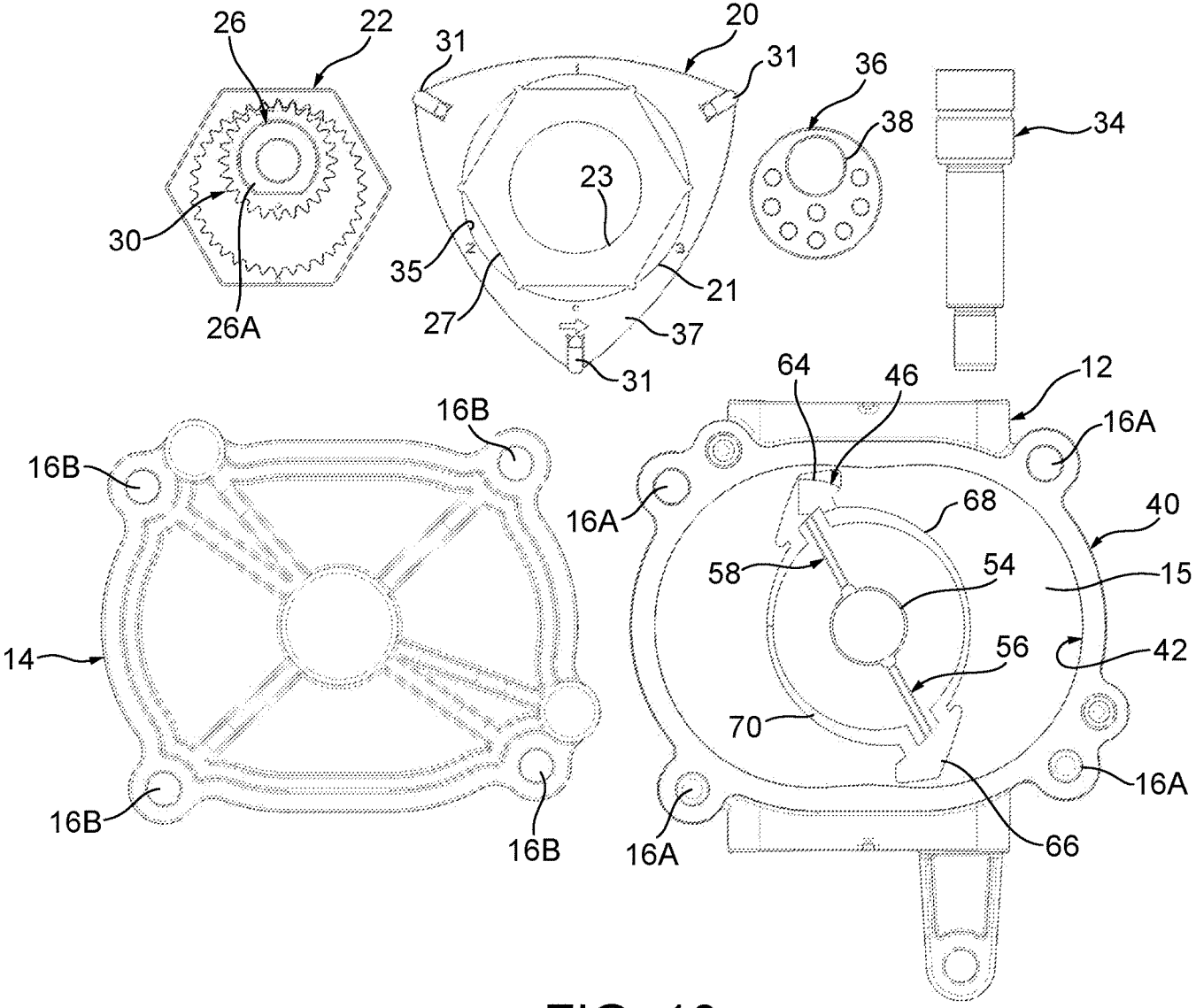
FIG. 13 shows parts of the vacuum pump of FIG. 1 when disassembled.

As shown in FIGS. 12 and 13, the housing 12 includes a chamber 40 having an internal space defined by a surrounding wall 42. In one embodiment, the internal space is ovular or substantially ovular in appearance. The surrounding wall 42 is shaped and/or designed to form an internal space having an epitrochoidal generated shape wherein a corresponding rotor is configured to rotate. The surrounding wall 42 is flanked by a front wall or cover 14 and a back wall 15. A flanged portion may be provided on the housing 12 that includes a number of openings 16A thereon for alignment with openings 16B of cover 14 (see FIG. 13, showing an underside view of the cover 14). Alignment of the openings 16A and 16B allows for insertion of fasteners 18 (e.g., bolts, as shown in FIG. 4) to secure the cover 14 to the surrounding wall 42, thus enclosing parts (e.g., rotor 20) within the housing 12 and forming a vacuum chamber therein. One or more inlayed seals 28 may be provided along edges of the flange/cover 14 to assist in sealing it with the housing 12. Pins 19 and/or other fasteners 18A may be provided for insertion through designated openings in parts of the housing as well, and used to secure the pump 10 to or within a structure (e.g., vehicle).

The shape of the internal space of the housing 12 provides an epitrochoidal space for rotating movement of rotor 20. The rotor 20 is rotatably received within the internal space of the chamber 40 (see FIG. 4) and is shaped with a number of edges that conjugate with the epitrochoidal shape of the internal space. Throughout this disclosure, "conjugate" refers to the joining of the rotor with the wall of the internal space; specifically, the relative movement of edges or lobes of the rotor towards the epitrochoidal form/wall, as well as the contact or sliding connection of the rotor tips or corners (e.g., seals 31) relative to the epitrochoidal form/wall. More specifically, as generally understood by one of ordinary skill in the art, (and referencing FIG. 4, for example) the chamber 40 of the housing 12 may be divided into smaller working chambers (e.g., one left, one right) by the rotor 20 as it rotates and orbitally revolves within the housing 12. During rotation, each side surface (or lobe surface, or edge) of the rotor 20 is brought closer to and then away from the epitrochoidal form, i.e., wall 42 of the housing, without fully contacting the wall 42 (e.g., due to manufacturing clearances). Also, corners or apices or tips of the rotor 20 are guided along the wall 42 in a sliding contact manner (e.g., via seals 31) during rotation of the rotor 20.

Accordingly, a number of dynamically changing smaller chambers are formed within the housing 12 as the rotor 20 revolves within and along the surrounding wall 42. In the exemplary illustrated embodiment herein, (as a result of using the illustrated three lobed rotor 20 with inner envelope design) there are two working chambers formed in chamber 40. The chambers are designed to input (or aspirate) and output (or expulse or expel) air using chamber inlets 64, 66 and outlets 50A, 52A (or outlets 50B, 52B) provided in the housing 12. Further details regarding a rotational cycle are described later with reference to FIGS. 22-25.

The body of the rotor 20 may have a polygonal shape that is similar to a spherical triangle (i.e., with three sides) having convex, bow-shaped flanks (see, e.g., FIGS. 12 and 14) forming its outer walls or edges, similar to rotors used in Wankel engines, in accordance with an embodiment. Although the illustrated embodiment of the pump 10 as shown in the Figures relates to a rotor 20 having three convex-shaped lobes/edges with an inner envelope, the Figures are not intended to be limiting with regards to the shape and/or boundaries of the rotor 20 and the pump 10. In one embodiment, the housing 12 (i.e., its surrounding wall of the internal chamber) has an epitrochoidal design with a Z parameter of three and the rotor has three lobes. In another embodiment, the housing 12 internal chamber has an epitrochoidal design with a Z parameter of two and the rotor has two lobes. In yet another embodiment, the rotor 20 and housing 12 have a four-lobe design with the internal space having a corresponding epitrochoidal shape (i.e., with a Z parameter of four). Still, five lobes may be used for the rotor with an epitrochoidal geometry of the housing 12 with internal chamber having a Z parameter of five, in accordance with an embodiment. The shape and/or design of the lobes of the rotor 20, i.e., its outer walls, may include bowed edges (convex or concave configurations), substantially straight edges, or curved edges, for example. The shape and/or design of the surrounding wall 42 in housing 12 (that forms its internal space) may be ovular or curved. In one embodiment, the shape and/or design of the rotor 20 and its lobes/outer edges may be dependent upon the shape of the epitrochoidal generated shape of the internal space formed by the surrounding wall 42 of housing 12.

Figure 14:
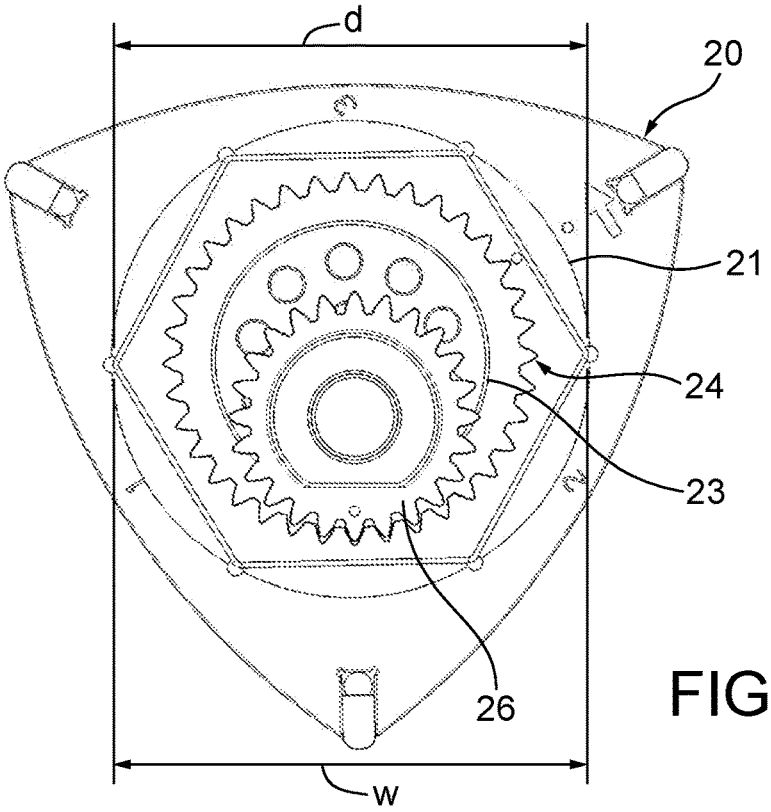
FIG. 14 shows a top perspective view of an assembly of the rotor and guide sprocket of the vacuum pump of FIG. 1.
Figure 15:
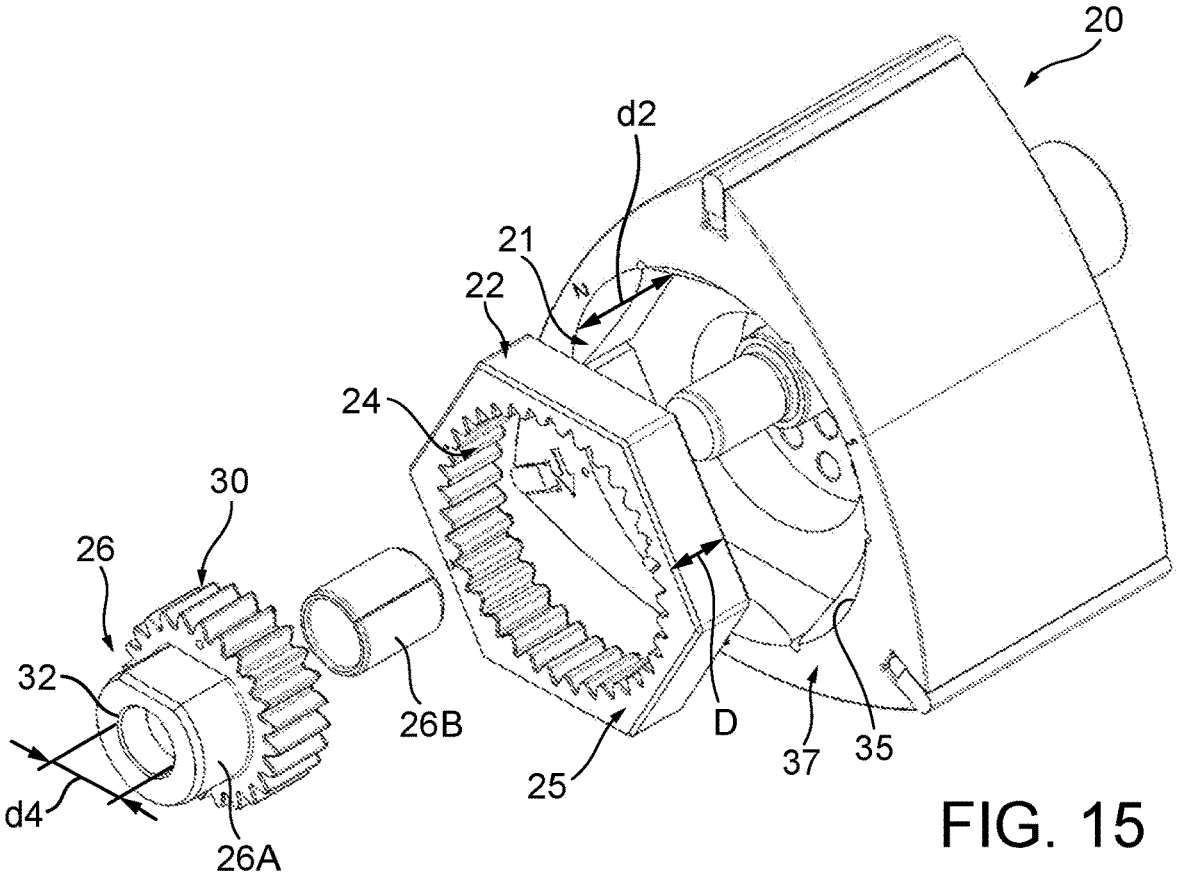
FIGS. 15 and 16 illustrate exploded views of the parts assembled with the rotor of the vacuum pump of FIG. 1 from the front and back, respectively.
Figure 16:
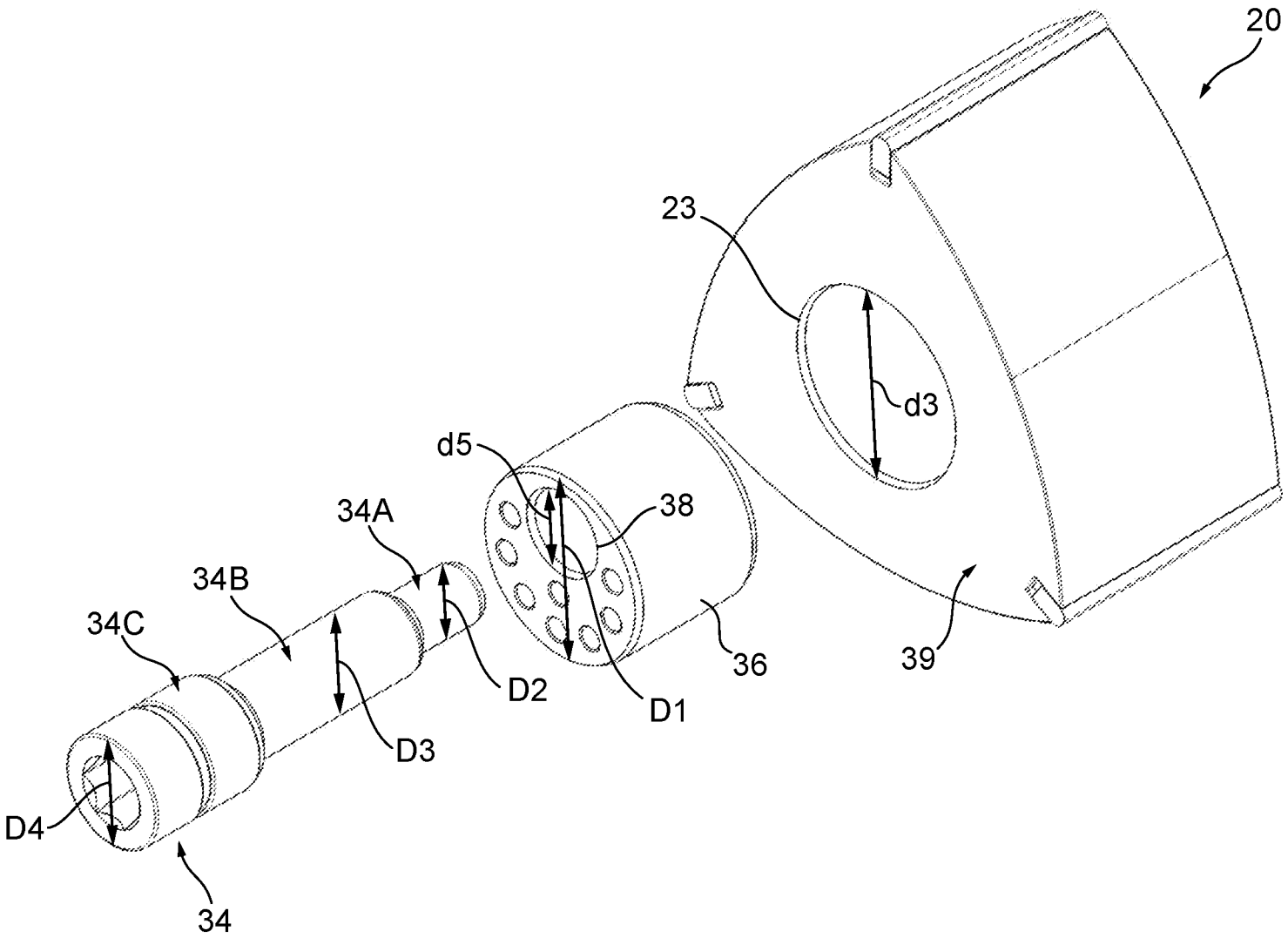

Rotation of the rotor 20 is performed eccentrically about an axis A and is implemented by an internally toothed guide gear 22, an externally toothed guide sprocket 26, and a drive shaft 34. FIG. 14 shows a top perspective view of an assembly of the rotor 20, guide gear 22, and guide sprocket 26 that may be used in the vacuum pump 10. FIGS. 15 and 16 better illustrate how such parts may be assembled.

For example, as shown in FIG. 15 (and also in FIG. 13), a body of the rotor 20 may have a pocket 21 on one side (e.g., on a front side) for receipt and integration of the guide gear 22 therein. The pocket 21 may be defined by an inner surface 27 (that extends a depth into the rotor body) and a wall 35. In one embodiment, the pocket 21 has dimensions that are sized to receive the guide gear 22 in a press-fit manner. In another embodiment, the guide gear 22 is slid into and received in the pocket 21. For example, in the illustrated embodiment, outer edges of the guide gear 22 are of a polygonal shape (e.g., a hexagon) and the guide gear 22 has a width W and an axial depth D. Accordingly, the pocket 21 may have a diameter d that is substantially equal to width W such that the edges of the guide gear 22 may be fit against the wall 35. The surface 27 (shown in FIG. 13) may be formed at a depth d2 that is similar to that of the axial depth D of guide gear 22. This is so that, when the guide gear 22 is press-fit into the pocket 21, an outer face 25 of the guide gear 22 is aligned with a face 37 of the rotor 20. The guide gear 22 may be secured within the pocket 21 via seals, for example, and/or press-fit into the rotor 20. The rotor 20 and guide gear 22 may be formed from a number of materials (e.g., steel, sinter, powdered metal, plastic, etc.) and manufactured in any number of ways and should not be limited. For example, the rotor 20 and guide gear 22 may be formed as a single part, molded (separately or together), and/or made of different materials and assembled together, e.g., by overmolding a different gear material to the formed rotor, or press-fit together. Of course, the illustrated design, shape, and configuration of the rotor 20 and guide gear 22 are not intended to be limiting. For example, in accordance with another embodiment, the wall 35 of pocket 21 may be formed of a corresponding shape to that of the edges of the guide gear 22. For example, in the illustrated embodiment, outer edges of the guide gear 22 are of a polygonal shape (e.g., a hexagon) and the guide gear 22 has an axial depth D. Accordingly, the pocket 21 may have complementary polygonal side walls (e.g., of hexagonal shape) such that the guide gear 22 may be press-fit therein.

The guide gear 22 may have a central opening defined by a plurality of radially extending female teeth 24 on the interior thereof. The guide sprocket 26 is received within the central opening of the guide gear 22. The guide sprocket 26 may have a plurality of radially extending male teeth 30 (see FIG. 13) on the exterior thereof that mesh with and guide movement of the internally toothed guide gear 22 (when the rotor 20 is rotated by the drive shaft 34). The guide sprocket 26 is designed to be fixed in place on the underside or bottom of the cover 14. The guide sprocket may have a shaft extension portion 26A that extends forwardly from the teeth 30, that can be press-fit into a corresponding portion or receiving area 14*a* within the cover 14 (see FIG. 6). The extension portion 26A has a drive shape (e.g., a flat portion thereon) for proper alignment and positioning within the area of the cover, allowing the guide sprocket 26 to be rotationally fixed in location. This ensures correct movement of the rotor 20 as it is driven by the drive shaft 34. That is, the rotor 20 moves around the fixed guide sprocket 26. Specifically, the rotor 20 is guided around the fixed guide sprocket 26 via teeth 24 of its guide gear 22 meshing and engaging with the teeth 30 of the guide sprocket 26.

Figure 18:
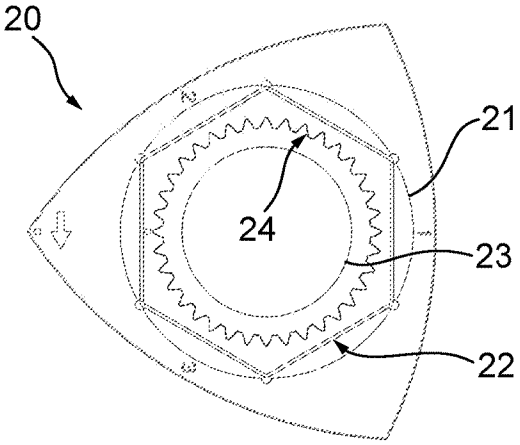
FIGS. 17 and 18 illustrate isometric and top views, respectively, of an exemplary rotor for use in the vacuum pump of FIG. 1 in accordance with one embodiment.
Figure 20:
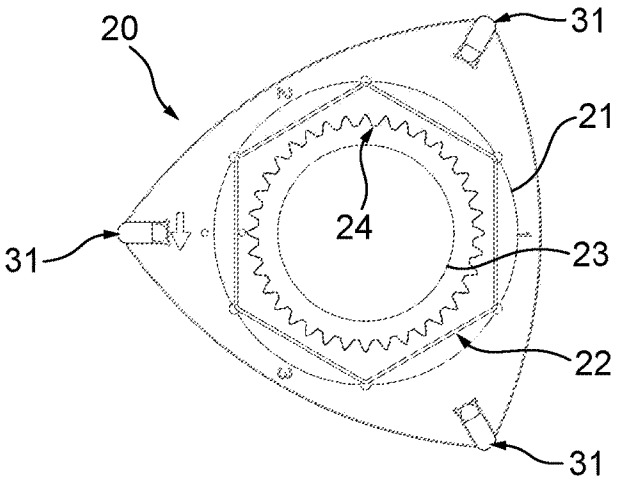
FIGS. 19 and 20 illustrate isometric and top views, respectively, of another exemplary rotor for use in the vacuum pump of FIG. 1 in accordance with another embodiment.
Figure 17:
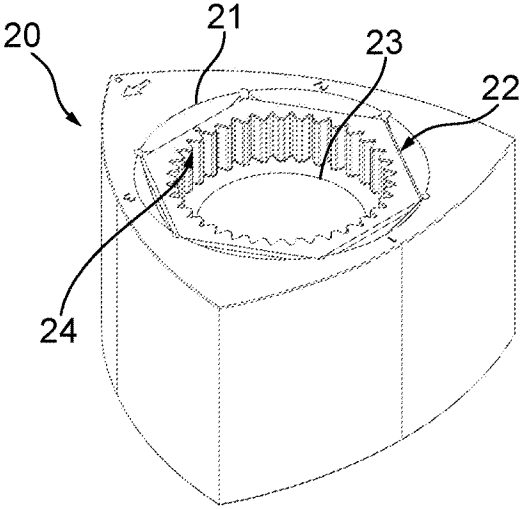
Figure 19:
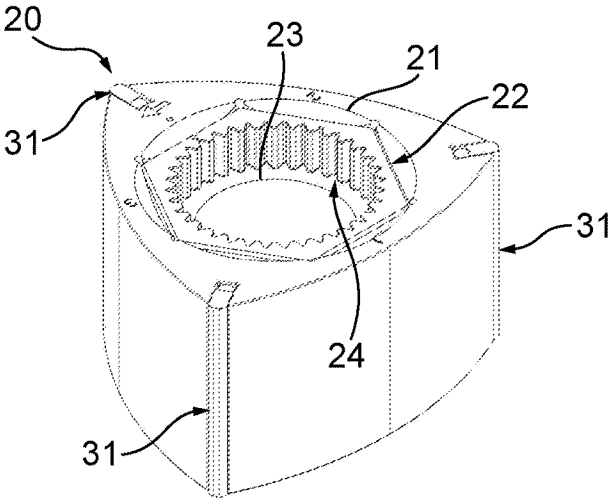
Figure 39:
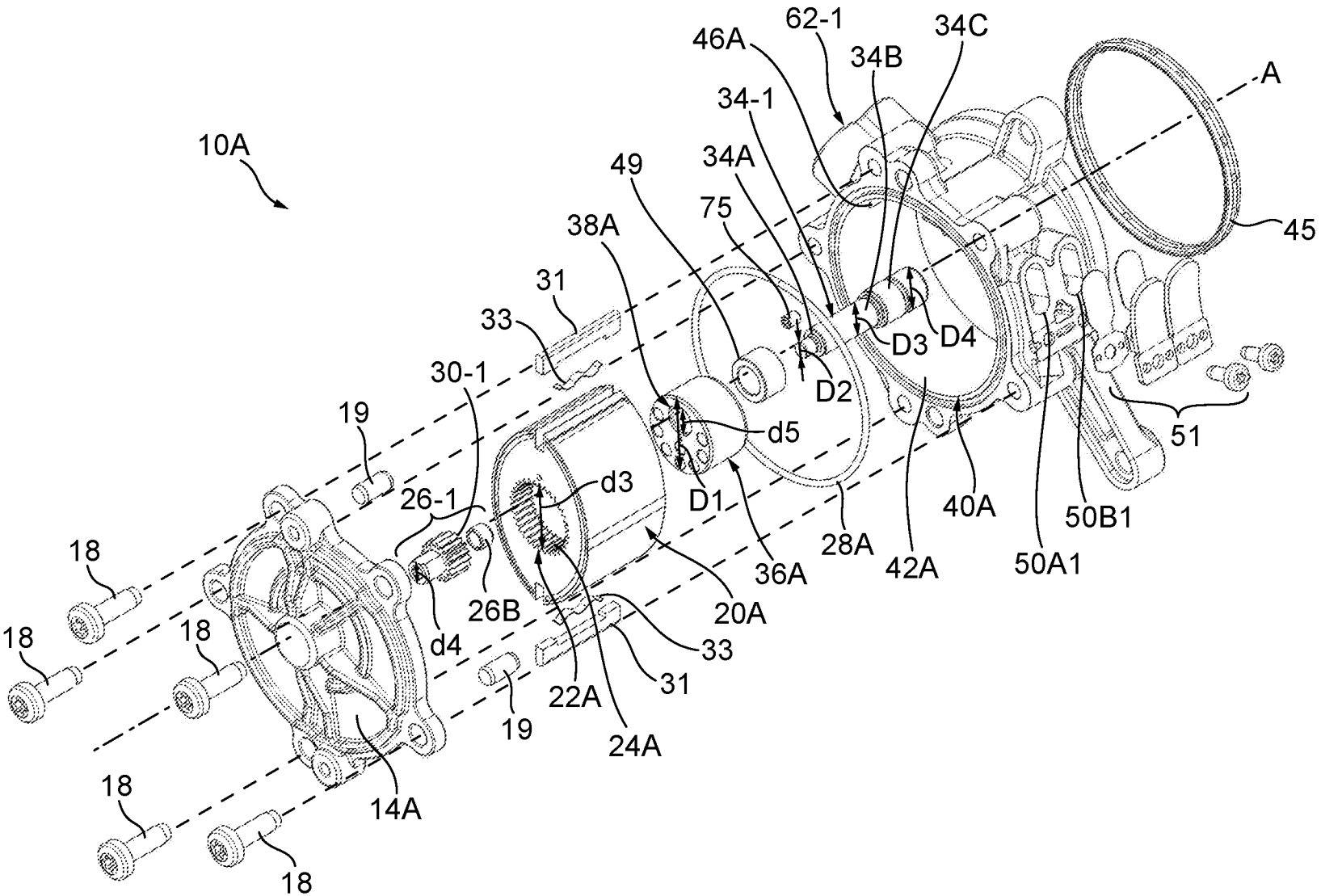
FIG. 39 shows an exploded view of the parts of the herein disclosed vacuum pump of FIG. 32 in accordance with an embodiment.

The rotor 20 may optionally have compression seals 31 provided at each of its tips, apexes, or corners of its body to seal and slidingly guide the rotor 20 against a periphery of the surrounding wall 42 of housing 12. The compression seals 31 may be received within openings provided at the tips or apexes, for example (see, e.g., FIG. 12). The compression seals 31 may include one or more pieces. In one embodiment, a spring or spring-like material may be provided within the openings along with the seals 31, to provide a radially outward force to the seals 31 and at the tips of the rotor 20. For example, as shown in FIG. 39 of the two-lobed design described later below, wave springs 33 may be provided along with the seals 31 in the apexes. In another embodiment, flat springs or leaf springs may be used with seals 31 and provided in the apexes of the rotor 20. FIGS. 17 and 18 illustrate on example of a rotor for use in the vacuum pump of FIG. 1 without seals, whereas FIGS. 19 and 20 illustrate another example of a rotor that may be used having compression seals at each apex.

Figure 6:
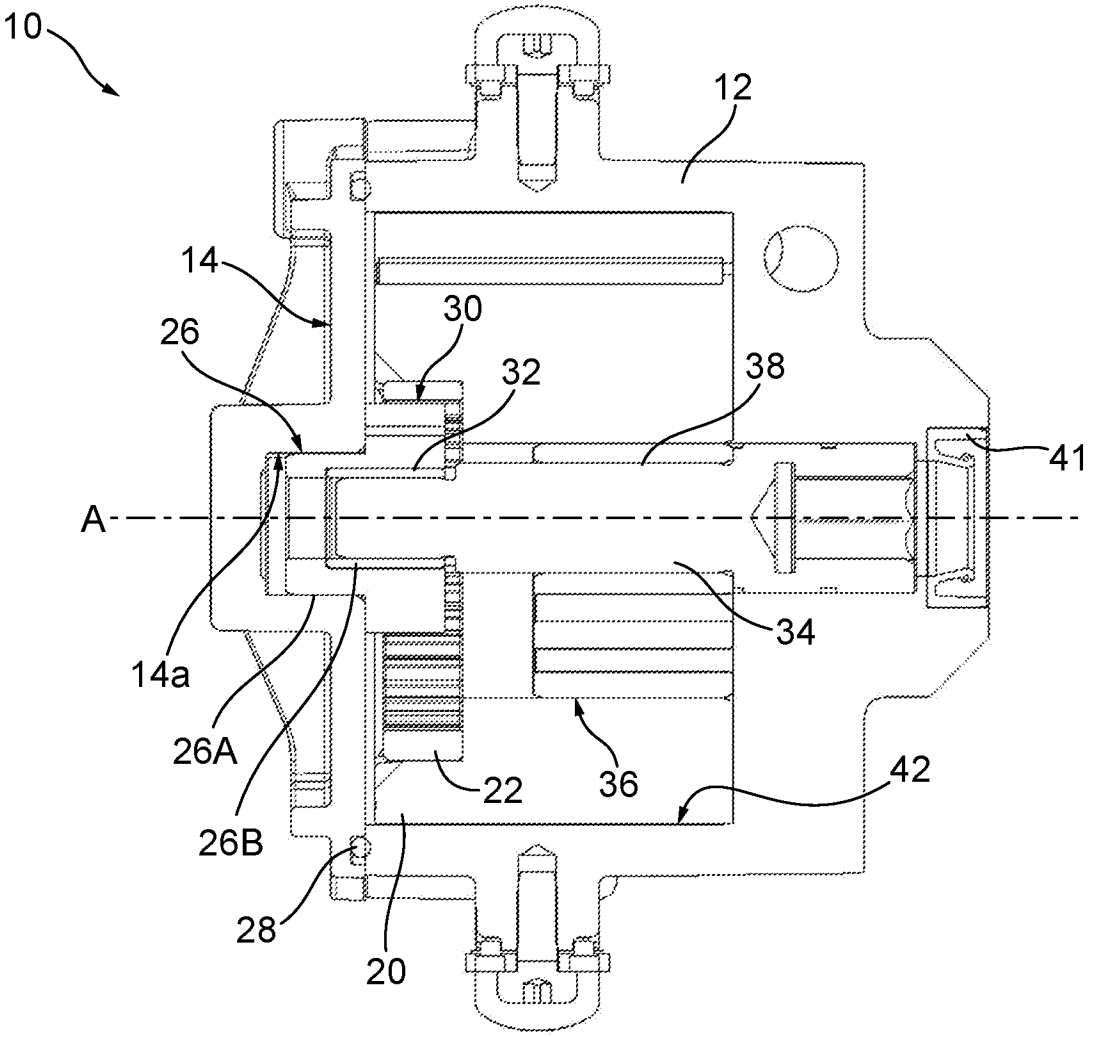
FIG. 6 is a cross sectional view of the vacuum pump taken along line 6-6 in FIG. 1, showing assembly of some parts inside the pump housing.

The drive shaft 34 is rotated by a driver (e.g., motor) about axis A. The driver may be connected to the drive shaft 34 through an opening 54 in the back of the housing 12, and secured using a connector 41 or seal. The drive shaft 34 is designed to extend through the rotor 20 towards cover 14, as shown in FIG. 6. An end of the drive shaft 34 is received within a hole 32 of the guide sprocket 26 and secured from rotating therein by a seal or bushing 26B, for example. To implement eccentric movement of the rotor 20 about axis A within the chamber 40 of housing 12, an eccentric rotation bearing 36 is provided.

The body of the rotor 20 further includes a hole 23 that that is formed for receipt of the drive shaft 34 therethrough. More specifically, the hole 23 is designed for receipt of the eccentric rotation bearing 36. Eccentric rotation bearing 36 may have its own receiving opening 38 for positioning of the drive shaft 34 therethrough. To connect the drive shaft 34 with the bearing 36, the drive shaft may be press-fit into the receiving opening 38 (see FIG. 6). The eccentric rotation bearing 36 rotatably fixes the rotor 20 relative to the drive shaft 34, while providing eccentric rotation of the rotor 20 about axis A as it is driven. FIG. 16 shows a back side isometric view of an end surface or back face 39 of the rotor 20 with hole 23 formed therein. The hole 23 extends through the pocket 21 (see FIG. 13). A diameter d3 of the hole 23 (see FIG. 16) is smaller than a diameter d of the pocket 21, but sized to receive the eccentric rotation bearing 36 therein in a rotatable manner, for example. Accordingly, the diameter d3 of the hole 23 in the body of the rotor 20 and a diameter D1 of the eccentric rotation bearing 36 may be substantially similar with sufficient clearance to permit rotation.

FIG. 16 also shows drive shaft 34 may include a stepped configuration for assembly with the rotor 20. The drive shaft 34 may include a first shaft portion or end 34A, a second shaft portion 34B, and a third shaft portion 34C (an opposite end to 34A), each having successively increasing diameters D2, D3, and D4. Since the end 34A is received for free rotation within the guide sprocket 26, the diameter D2 of end 34A may be sized slightly smaller than a diameter d4 (see FIG. 15) of the hole 32 of the guide sprocket 26. The diameter D3 of the second shaft portion 34B may be substantially similar to a diameter d5 of the receiving opening 38 of the eccentric rotation bearing 36. The third shaft portion 34C may be sized to fit within an opening 54 (see FIG. 13) provided in and through the back wall 15 of the housing 12. The third shaft portion 34C may include a receiving opening (e.g., hex) within its end, for receipt or connection with the driver shaft (e.g., of a motor) therein (see also FIG. 6). A circumferential groove may be provided in an outer edge third shaft portion 34C for lubrication purposes (e.g., to receive lubricant when secured in housing 12).

Accordingly, assembly of the parts as generally shown in FIG. 14, along with the drive shaft 34 therethrough, provides eccentric rotation of the rotor 20 within the chamber 40 of the housing 12 during use of the pump 10. During such rotation, a number (e.g., two) of smaller chambers are formed within chamber 40 that are designed to intake air, compress, and exhaust pressurized air from the pump 10. To input and output air relative to the smaller chambers, a number of configurations may be used.

For example, in accordance with one embodiment, a vacuum inlet is provided for inputting air into the housing 12. As shown in FIGS. 5, 9, 10, 11, 26-27, and 29-30, the vacuum inlet includes an input passageway 62 that extends through a bottom of the housing (below the chamber 40) and back wall (e.g., see FIG. 11) and receives (pulls via vacuum) air through an opening 62A (e.g., see FIG. 10) provided on an outside of the back wall 15 of the housing 12. Air is communicated and drawn through the passageway 62 and into at least one axial inlet port 46 (e.g., see FIGS. 26-27). FIG. 28 shows an example of two axial inlet ports 46 and 48 used in pump 10. Axial inlet port 46 (and/or inlet port 48) fluidly connects to a chamber inlet 64 (and/or a chamber inlet 66). In accordance with the illustrated embodiment, the inlet port(s) 46 and/or 48 are positioned axially due to the fact that the opening and closing position (inlet timing) is defined by the rotor position and shape. In another embodiment, radial positioned inlet port(s) may be used (upon consideration of back flow from outlet to inlet and depending on a clearance between the rotor (i.e., its sides or edges) and housing at top dead center). Chamber inlet 64 selectively draws and delivers air in the axial direction (to a smaller chamber formed in the chamber 40) under negative pressure (vacuum), dependent upon the position of the rotor 20. The housing 12 further includes another chamber inlet 66 that is generally positioned diagonal to the chamber inlet 64. Chamber inlet 66 is also designed to receive input air and to selectively draw air in the axial direction (to a smaller chamber formed in the chamber 40) under negative pressure as the rotor 20 is rotated. Each of the chamber inlets 64 and 66 are formed on the inside of the back wall 15. For example, the chamber inlets 64, 66 may be machined at depth within the wall 15.

Figure 7:
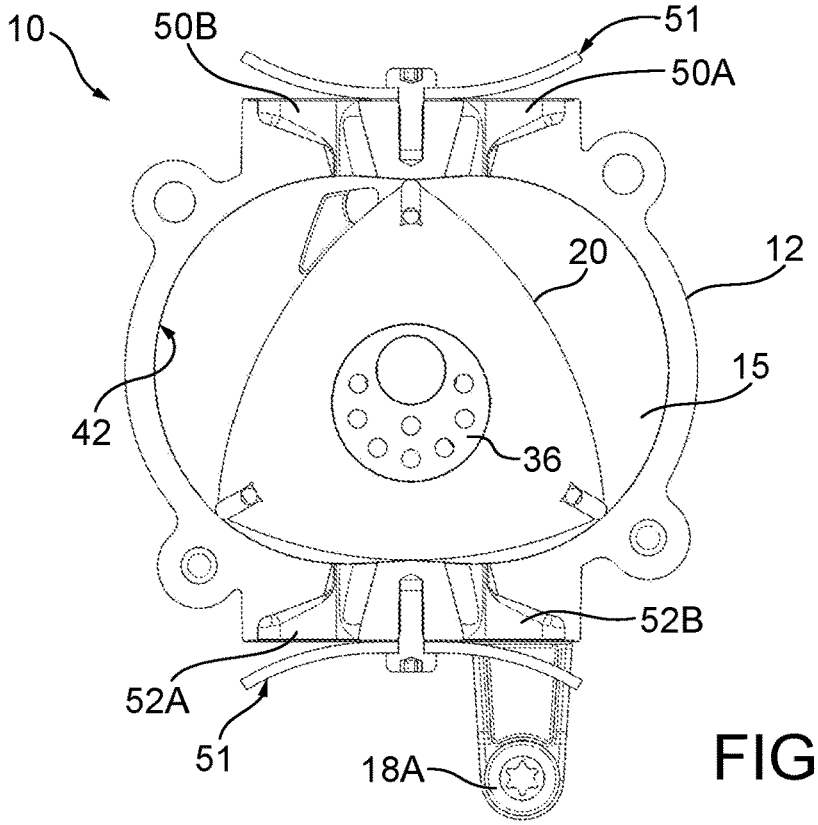
FIG. 7 is a cross sectional view of the vacuum pump taken along line 7-7 in FIG. 5, showing assembly of some parts inside the pump housing.
Figure 8:
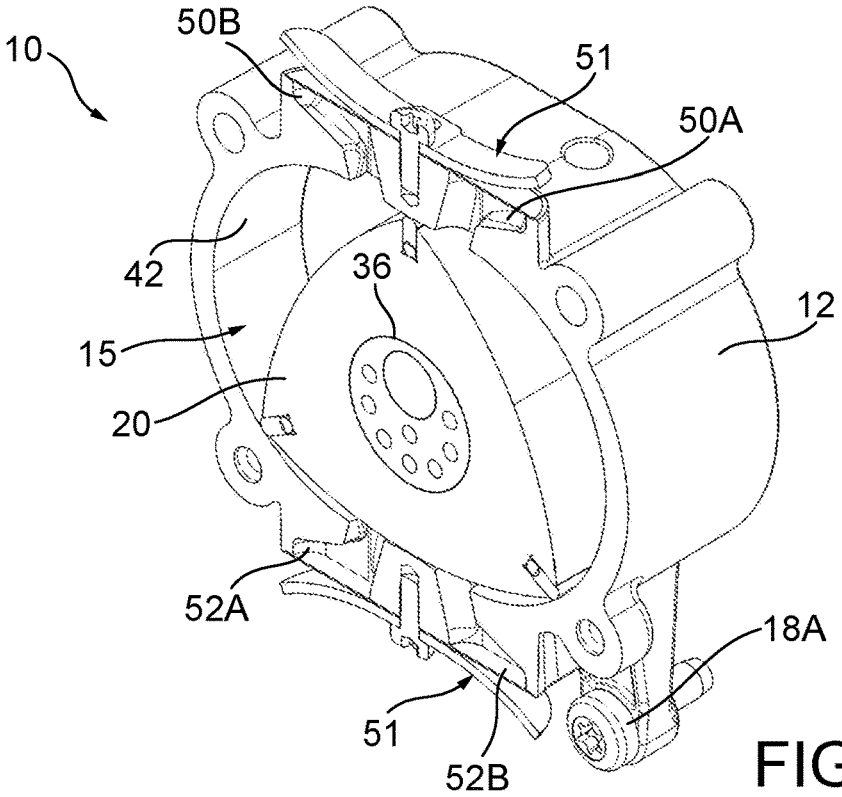
FIG. 8 is an isometric view of the cross-sectional view of FIG. 7.

Since the exemplary illustrated pump 10 and rotor 20 works as a two-stroke system, there are two separated, independent pump working chambers designed or implemented in the housing 12—e.g., one on the left side and one on the right side (as shown in FIG. 9), always separated by the rotor 20. During one rotor revolution, there are three evacuation cycles completed for each chamber. Depending on the size of the pump chambers and the possibility of design and packaging, one or more channels need to be applied. In the illustrated embodiment of pump 10, each chamber needs to be equipped with minimum of one inlet passageway/channel and one outlet passageway/channel. Outlets 50A, 52A output or expel air under positive pressure from the chambers as the rotor 20 is rotated under normal or forward rotation, while outlets 50B, 52B are additional outlets used as the pump/rotor 20 is rotated backwards (outlets 50B, 52B are mirror images of the outlets 50A, 52A). Each of the outlets 50A, 52A and 50B, 52B includes a passageway (or channel) and an output opening that extends radially relative to axis A, in accordance with an embodiment. As shown in FIG. 12, the openings of the outlets 50A, 52A and 50B, 52B may be provided through the surrounding wall 42 such that they are positioned radially opposite to one another. The outlets and are designed in a way that the cross sectional area allows a sufficient flow without restriction (e.g., the passageway of each of the outlets expands from a smaller port positioned on the surrounding wall 42 of the housing 12). The size of the outlets may be determined based upon pump displacement and exhaust speed. The radial positioning of the outlets 50A, 52A and 50B, 52B allows air to flow out of the chamber from inside housing when the chamber volume is the smallest during rotation of the rotor 20 (e.g., when the rotor 20 is positioned as shown in FIG. 7, it is still connected to outlet 52A; see also FIG. 14).

Figure 5:
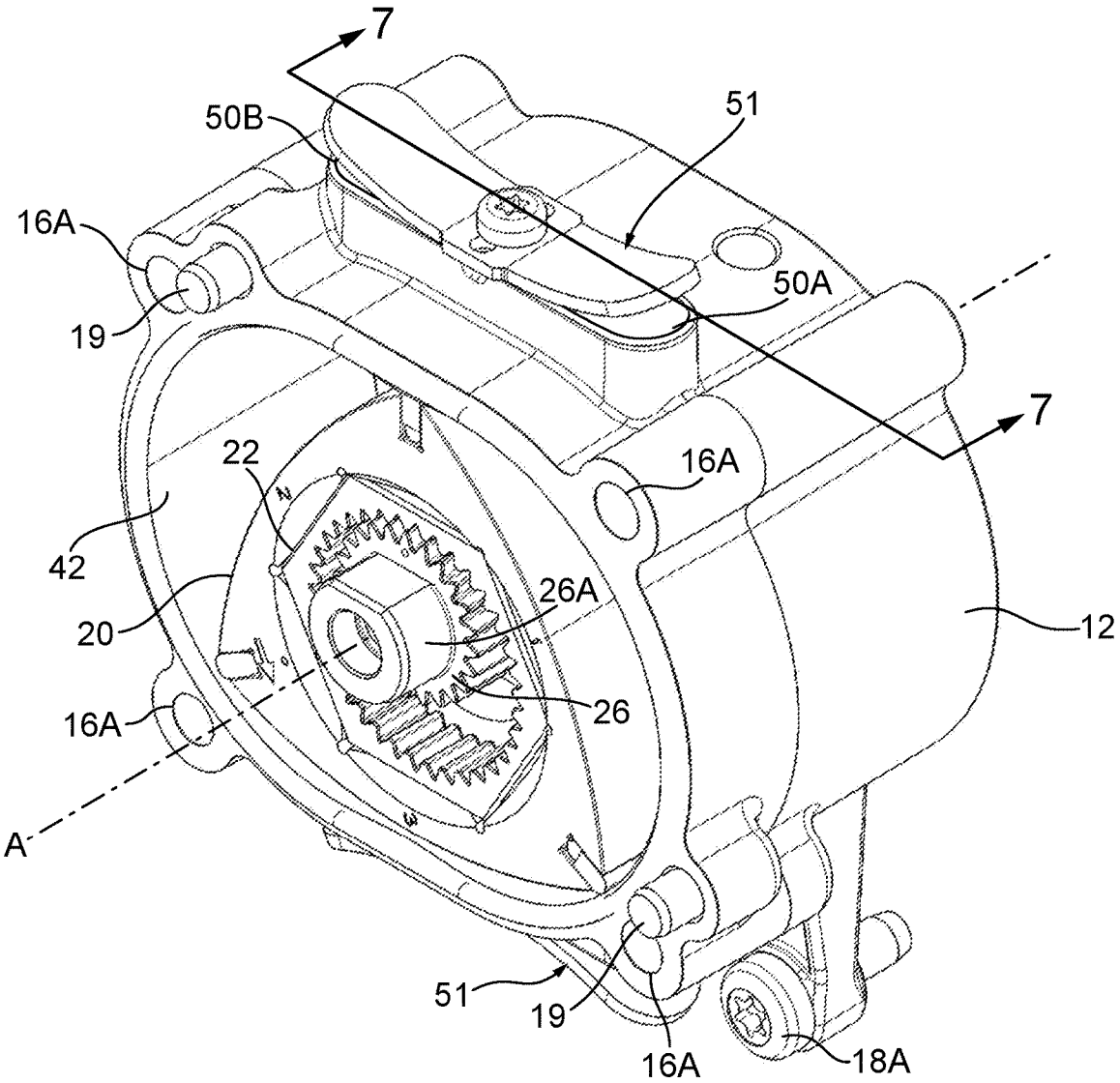
FIG. 5 is an isometric view of the view shown in FIG. 4.

In accordance with an embodiment, the outlet openings of the passageways of each of the outlets 50A, 52A and 50B, 52B is equipped with reed valve 51, that includes a movable reed and a reed stop portion for limiting movement of the reed, for example. As shown in FIGS. 4, 5, and 12, for example, a reed valve 51 may be provided on either side of the housing 12 (e.g., top and bottom). Each valve 51 is configured to substantially cover the radial outlets provided on the same side of the housing, i.e., one valve 51 is positioned to cover outlets 50A, 50B and another valve 51 covers 52A and 52B.

In accordance with an embodiment, the outlet channel timing defines the shape of the outlet channel geometry (e.g., the outlet needs to open after maximum chamber volume is achieved).

Figure 10:
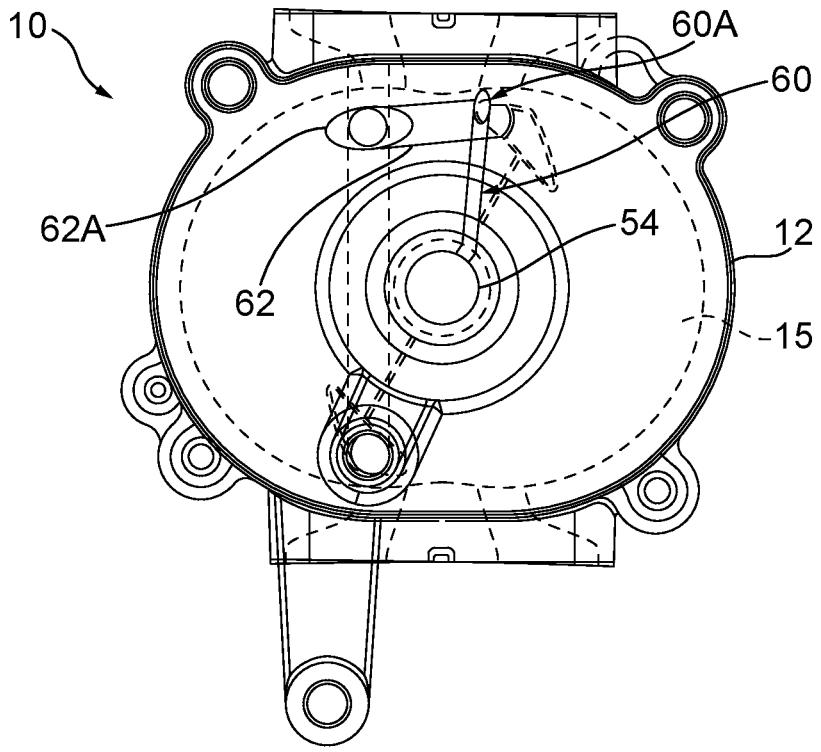

Although the outlets are positioned radially in the illustrated embodiments, in one embodiment, the outlets may be positioned in an axial direction. Still, positioning of the outlets in the radial direction may be easier during casting, and further allows for use and easier positioning of the reed valves 51. FIG. 10 is a schematic view showing an example configuration for positioning the inlets 64, 66 and outlets 50, 52 in the housing 12, with the rotor 20 therein.

FIGS. 22-25 are schematic illustrations representing steps of a cycle as the three-lobe rotor 20 performs a single (clockwise) revolution in the housing 12 of the vacuum pump 10. The illustration of a clockwise rotation is for explanatory purposes only. That is, in accordance with an embodiment, during use of the pump 10, the rotation of the rotor 20 is performed in a counter clockwise manner within the housing. For each rotor rotation, there are three evacuation cycles completed for each chamber. Center A is the center of the drive shaft 34, which also equals the center of the guide gear (guide sprocket 26). Center B is the center of the rotor 20. These Figures generally designed to show operation of pump 10 and the vacuum chambers formed in the chamber 40 during rotation of the rotor 20 around and along the surrounding wall 42. As the rotor is rotated and its sides/lobes/edges contacts the inner wall of the housing, it effectively seals or closes the openings (i.e., the inlets and outlets) along with the tips (e.g., via seals 31) in contact with the housing wall. The positioning of the chamber inlets 64, 66 and outlets 50, 52 as shown in FIG. 10 and FIGS. 22-25 is for descriptive purposes only and is not intended to be structurally limiting.

When the rotor 20 is in a first position, such as shown in FIG. 22, outlet 50 is closed, chamber A1 (aspiration 1) has nearly completed drawing air from chamber inlet 66 and chamber A2 (aspiration 2) draws air from chamber inlet 64. Chamber E2 (expulsion 2) expulses air through open outlet 52. When driven to a second position, represented in FIG. 23, the rotor 20 closes chamber inlet 66 and opens outlet 50, and chamber A1 is changed from aspiration 1 to expulsion 1 (E1) by expulsing air through outlet 50. Chamber A2 continues to draw air from chamber inlet 64 (but nearly complete). Chamber E2 continues to expulse air through outlet 52. FIG. 24 shows a third position of the rotor 20 wherein chamber E1 continues to expulse air through outlet 50 and chamber A2 ceases aspiration through chamber inlet 64 because it is closed by the rotor. Chamber E2 changes to A1 by opening inlet 66 and beginning to draw air from chamber inlet 66. When the rotor 20 moves to its fourth position, represented in FIG. 25, chamber E1 continues to expulse air through outlet 50. Chamber A2 changes to E2 by closing chamber inlet 64 and expulsing air through outlet 52. Chamber A1 continues to draw air from chamber inlet 66.

As previously noted, the drive ratio between the gears is dictated by the type of epitrochoid design used, i.e., $(Z-1)/Z$. The gear ratio in the illustrated embodiment of FIGS. 1-31 between guide gear 22 and the fixed guide sprocket 26 is 2/3, with a drive ratio of 1/3 between the rotor 20 and drive shaft. The difference in the two centers is defined by the pump eccentricity. This drive ratio, and the eccentricity of center A (i.e., the center of the drive shaft) to a center B (i.e., the center of the rotor), results in the eccentric movement of the rotor 20 around guide sprocket 26 and within the epitrochoidal housing 12. Accordingly, for every 360° (degrees) in drive shaft rotation, the rotor 20 rotates 120° (degrees).

Chamber inlet 66 may receive input air for delivery in a number of ways. In accordance with one embodiment, illustrated in FIGS. 26 and 29, for example, the chamber inlets 64 and 66 may be cross-connected via one or more internal inlet channels 68, 70 for fluid communication of air. For example, air may be pulled through passageway 62 through axial inlet port 46 and directly into chamber inlet 64 via negative pressure. Chamber inlet 66 may receive input air indirectly from the passageway 62 via inlet channels 68 and 70. That is, air is directed (pulled via vacuum) from chamber inlet 64 along and through each of the inlet channels 68 and 70 and into the chamber inlet 66. The channels 68 and 70 are machined into an inside of the back wall 15 of the housing 12 such that they are positioned beneath the rotor 20 (or below or behind the rotor) when the rotor is assembled in the housing 12. In the illustrated embodiment, the inlet channels 68 and 70 are curved paths that are spaced a radial distance from and positioned around the opening 54 (for the drive shaft 34) in a manner such that the back face 39 of the rotor 20 overlaps and seals the inlet channels 68, 70 at all times, i.e., in all positions of the rotor. This configuration of inlet channels 68 and 70 is further designed to avoid overlap by the center of the rotor 20, thus avoiding a vacuum being created by the center of the rotor 20.

Figure 27:
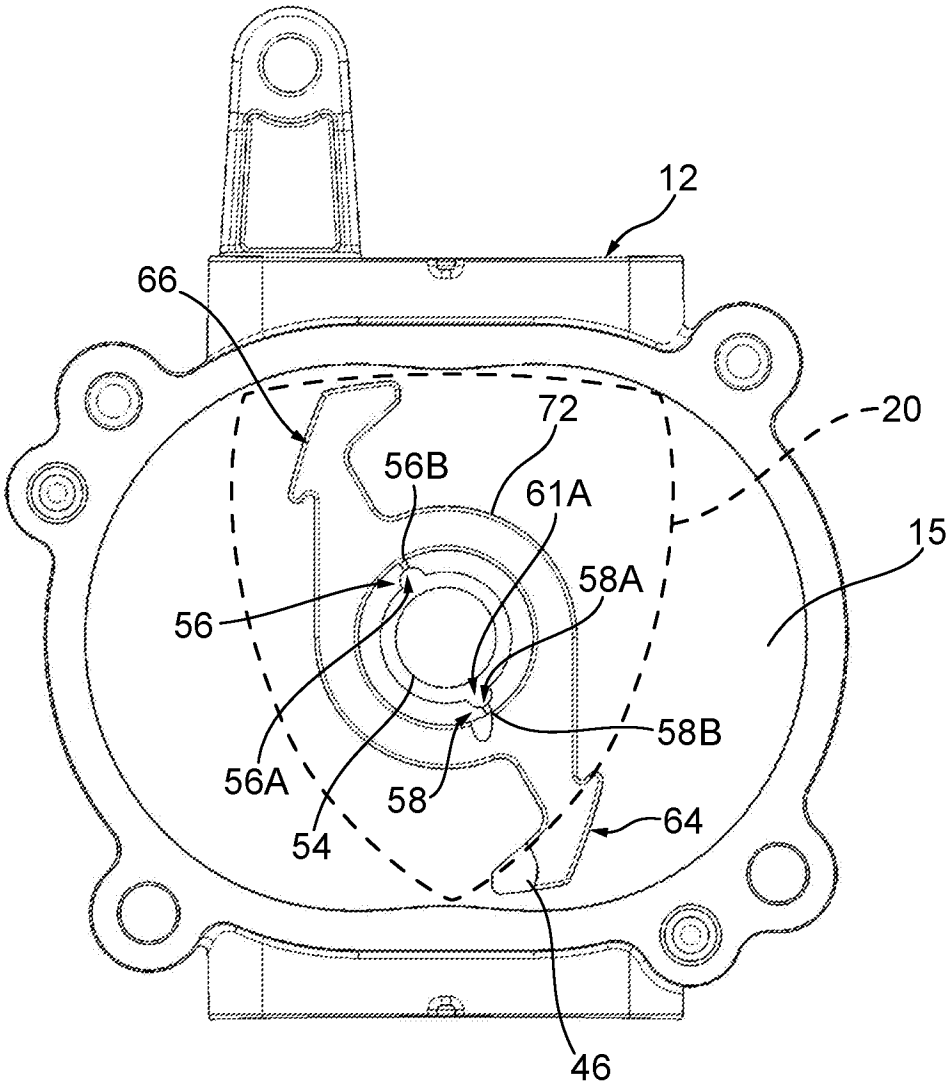
FIG. 27 is a front view of the housing of the vacuum pump of FIG. 1, showing inlets and outlets and an internal channel in accordance with another embodiment of this disclosure.
Figure 28:
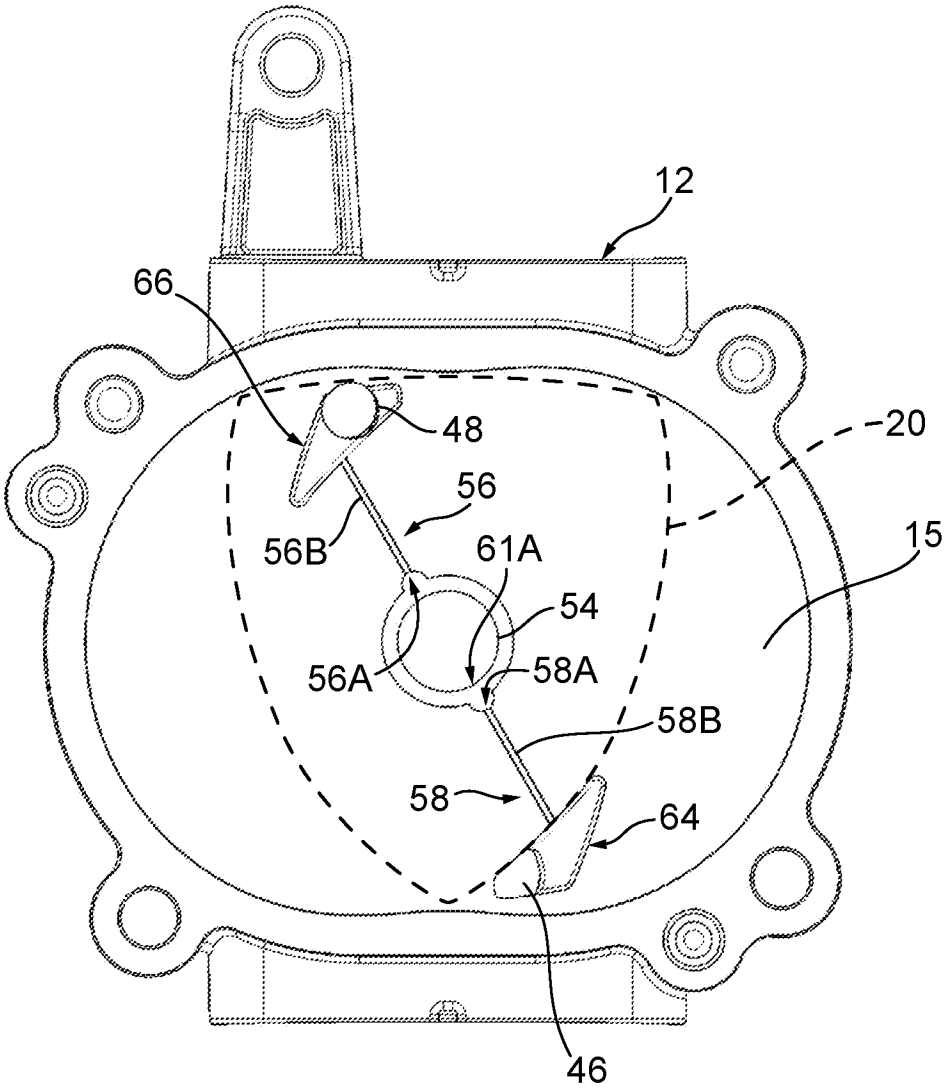
FIG. 28 is a front view of the housing of the vacuum pump of FIG. 1, showing inlets and outlets and an internal channel in accordance with yet another embodiment of this disclosure.
Figure 29:
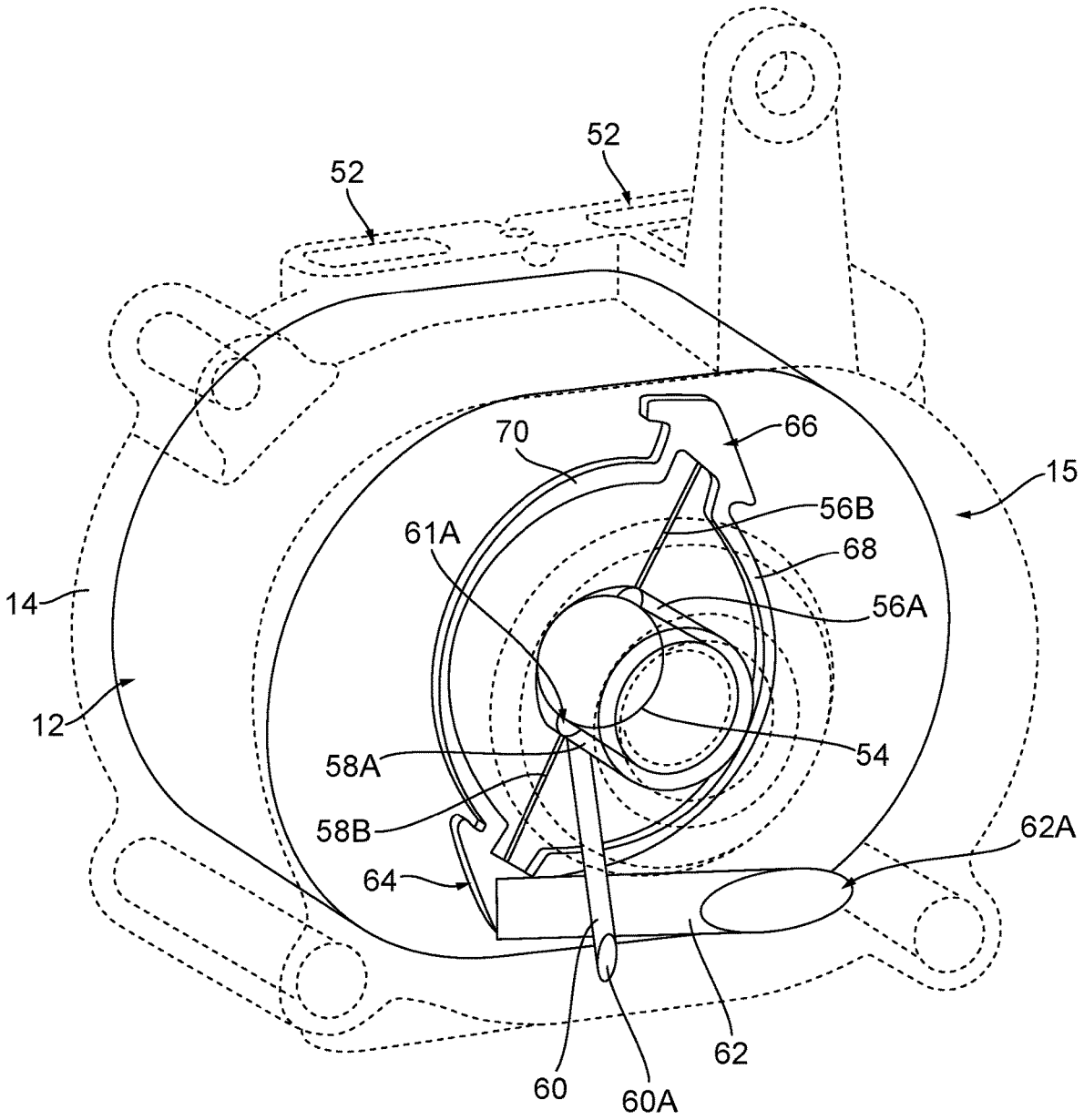
FIGS. 29, 30, and 31 are back perspective and schematic views of the internal channels of FIGS. 26, 27 and 28, respectively, positioned within a vacuum pump.
Figure 30:
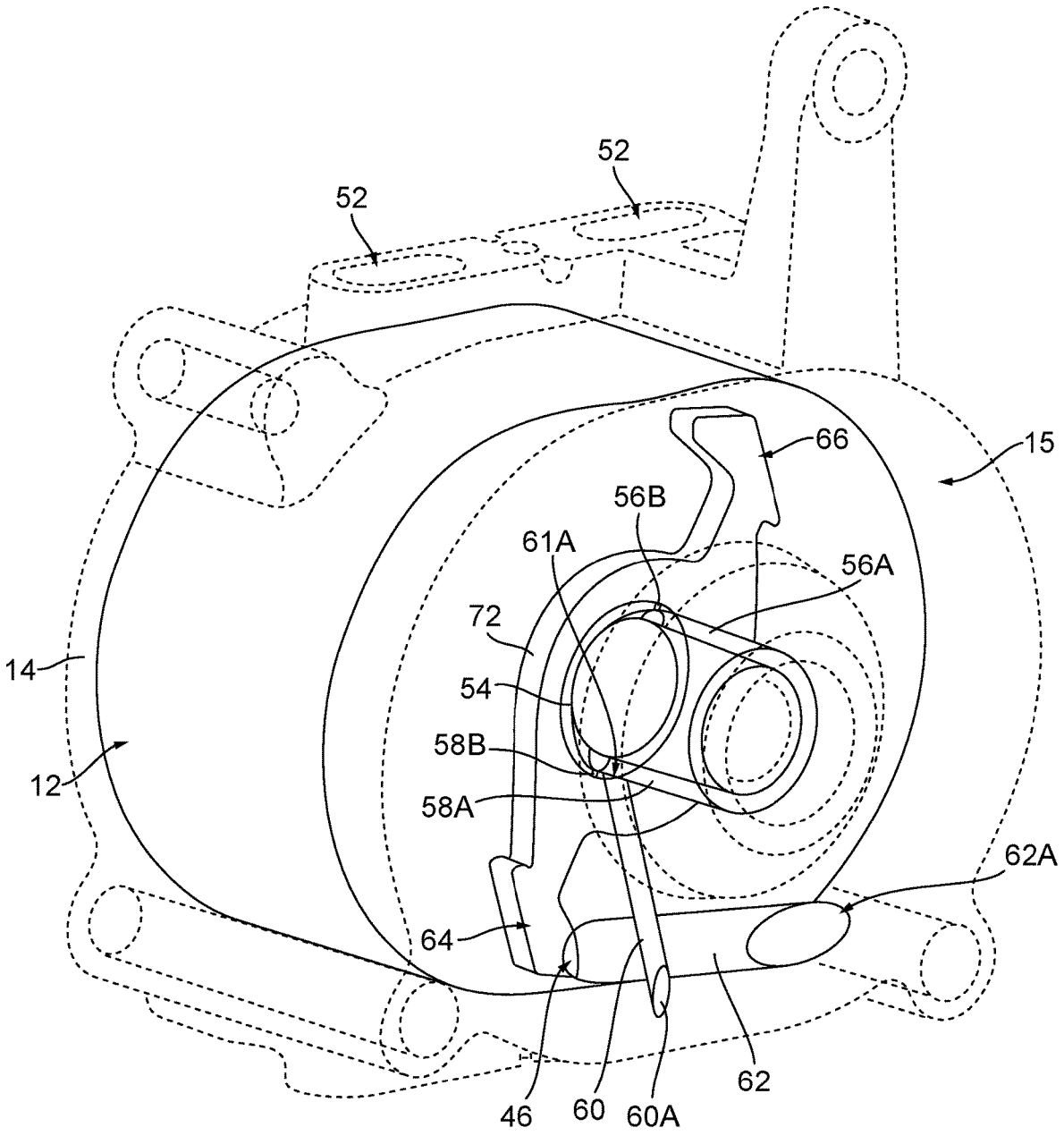

FIG. 27 illustrates an alternate embodiment of housing 12 that similarly uses a single inlet port 46 as part of the vacuum inlet into housing 12. FIG. 30 shows a back view of the housing 12 in this embodiment. The chamber inlets 64 and 66 are fluidly connected via an inlet channel 72 in the form of an enlarged path. Air is communicated (pulled via vacuum) from chamber inlet 64 along and through inlet channel 72 and into the chamber inlet 66. The channel 72 is machined into an inside of the back wall 15 of the housing 12 and positioned beneath the rotor 20 (or below or behind the rotor) when the rotor is assembled in the housing 12. The path of the inlet channel 72 includes branches that extend from each of the chamber inlets 64 and 66 and has a portion that extends around the opening 54. The center of the rotor 20 overlaps the inlet channel 72, thus creating a vacuum in the center of the rotor assembly.

Figure 31:
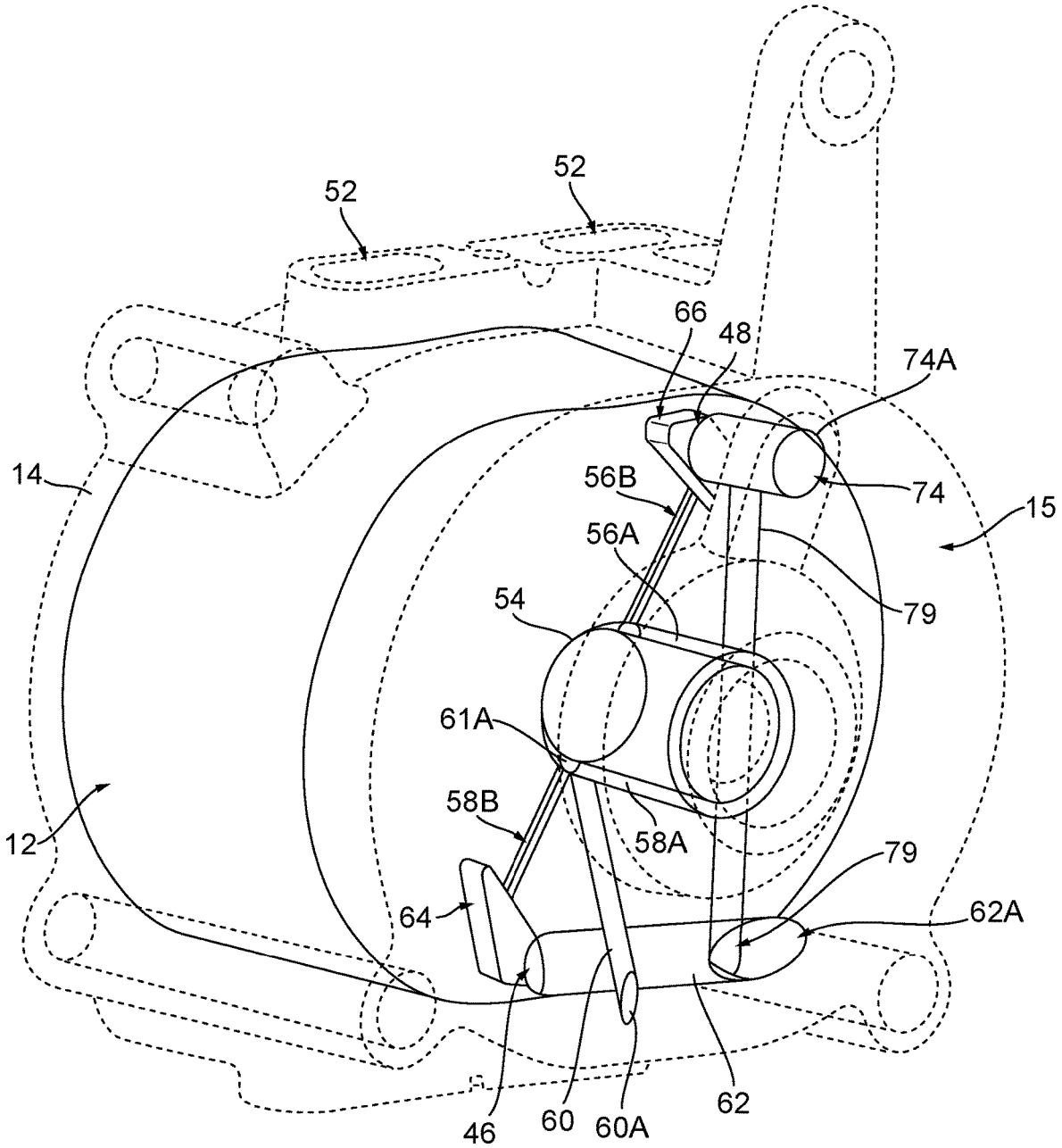

FIGS. 28 and 31 illustrate front and back perspective views of yet another embodiment of the housing 12 that may be used as part of the vacuum pump 10. The housing 12 has two radial outlets 50 (not shown) and 52 as previously described, as well as a vacuum inlet with the input passageway 62 and axial inlet port 46 to chamber inlet 64. A second passageway 74 is connected to axial inlet port 48 which is fluidly connected to a chamber inlet 66. In this embodiment, passageway 74 may be connected to input passageway 62 via a vertical channel 79 machined in the material at the back side of the housing, i.e., rather than channel(s) machined into the internal wall of the internal chamber. The hole shown at 74A is a machining hole that is plugged and is not an additional vacuum inlet. Accordingly, air received through opening 62A may be distributed or divided between the channels or passageways 62 and 74. Air is communicated (pulled via vacuum) into opening 62A provided on an outside of the back wall 15 of the housing 12, through the passageway 62 and into the axial inlet port 46 (e.g., see FIG. 28) formed in the chamber inlet 64. The vertical channel 79 extending from passageway 62 to passageway 74 further communicates air received through opening 62A to the passageway 74 and then the axial inlet port 48, and thus chamber inlet 66. Chamber inlet 66 selectively delivers air in the axial direction (to a smaller chamber formed in the chamber 40), dependent upon the position of the rotor 20, as previously described. Accordingly, the housing 12 shown in FIGS. 28 and 31 is designed to draw air under negative pressure directly to each of the chamber inlets 64 and 66.

The two axial chamber inlets 64, 66 and two radial outlets 50, 52 in the housing 12 of pump 10 may be connected or positioned in any number of ways. The configurations for establishing input of air to the housing 12 as shown in FIGS. 26-31 are exemplary and not intended to be limiting.

Figure 11:
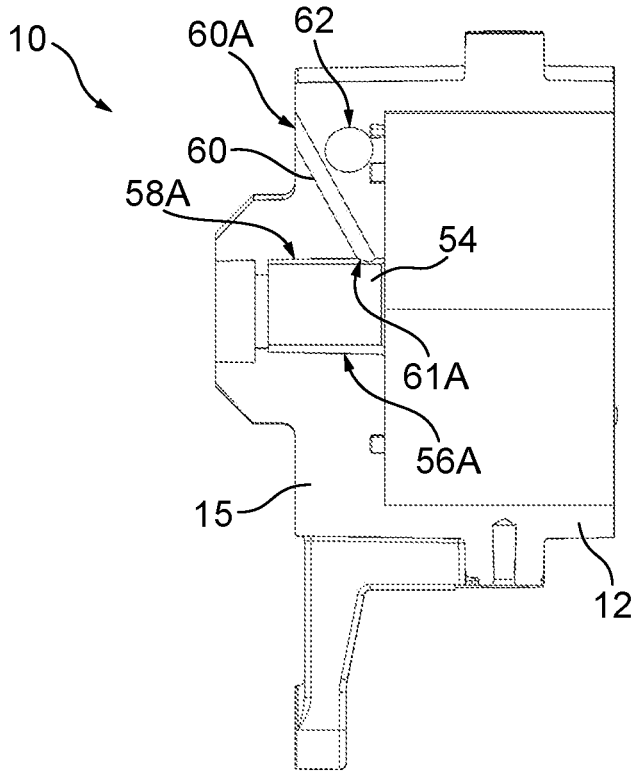
FIG. 11 is a cross-sectional view of the housing of the vacuum pump showing an alternate view of the passageways for oil and air.

In addition to drawing air (via passageway 62) into the housing 12 during rotation of the rotor 20, the vacuum pump 10 may be designed to feed or draw lubricant (e.g., oil) through a fluid inlet (60A) to the drive shaft 34 to create a fluid bearing and into the chamber inlets 64, 66 of the pump to selectively feed oil into the housing 12 to seal the chambers at the apices of the rotor 20 (i.e., when used as a "wet" vacuum pump). Thus, despite the number of vacuum inlets and/or inlet channel design provided in the housing 12, the vacuum pump 10 may further include a fluid inlet path 60, shown in FIGS. 10 and 11, for example, for drawing a lubricant (e.g., oil) into the housing 12 and communicating said lubricant to both the drive shaft and into the internal space of the housing (chamber 40). A fluid inlet opening 60A to the fluid inlet path 60 may be provided in the back wall 15 of the housing 12, for example. As shown in FIG. 11, for example, the fluid inlet path 60 may be a channel or tunnel that extends through back wall 15, and is positioned below or behind the rotor 20. The fluid inlet and path is subject to a pressure differential generated in the internal space for drawing the lubricant therethrough. In accordance with an embodiment, the fluid inlet path is a drive shaft channel (and thus is also referred to as "drive shaft channel 60" herein) that leads lubricant to the opening 54 for the drive shaft 34 for lubrication thereof. In one embodiment, as shown in the Figures, for example, the drive shaft channel 60 extends radially through a wall (e.g., back wall 15) of the housing for drawing lubricant to the drive shaft 34.

The fluid inlet path or drive shaft channel 60 is configured to draw pressurized lubricant (e.g., from the engine gallery or other pressure source) through opening 61A into one or more lubricant feed channel(s), generally represented as 56 and 58 in the Figures (see, e.g., FIGS. 11 and 26-31). That is, as a result of a pressure differential (under negative pressure) generated in the internal space of the chamber 40, lubricant is drawn or fed through the fluid inlet 60A and channels 60, 56, and 58, and into the housing. The feed channels 56, 58 may each include a first channel portion, or chamber channel 56A, 58A that is machined into the opening 54, in the back wall 15. The chamber channel portions 56A, 58A are positioned beneath (or below or behind) the rotor when the pump is assembled. The path of each chamber channel 56A, 58A extends in an axial direction adjacent to the drive shaft 34 (see, e.g., FIGS. 29-31) through a wall (e.g., back wall 15) of the housing 12 for drawing lubricant into the internal space of the chamber 40. Accordingly, pressurized lubricant may be delivered into opening 60A, through inlet path 60, through and from opening 61A (see FIG. 11) into the axial channel portions 56A, 58A. Lubricant is then drawn towards the internal space into the chamber 40, and further around the drive shaft 34 to create a fluid bearing as the drive shaft 34 rotates about axis A.

In accordance with an embodiment, the opening 61A acts as a junction to connect the drive shaft channel 60 and the feed channels 56, 58. Specifically, as seen in FIG. 11, for example, the opening 61A may connect channel 60 to chamber channels 56A, 56B such that the fluid inlet 60A may be used to deliver lubricant to opening 61A and thus feed lubricant to both the opening 54 for the drive shaft 34 and the chamber channels 56A, 56B.

In one embodiment, the drive shaft channel 60 is formed in the housing to extend from the fluid inlet 60A to an opening 54 receiving the drive shaft 34, and the chamber channels are formed in the housing to extend from the opening 54 to the internal space of the chamber 40.

Figure 26:
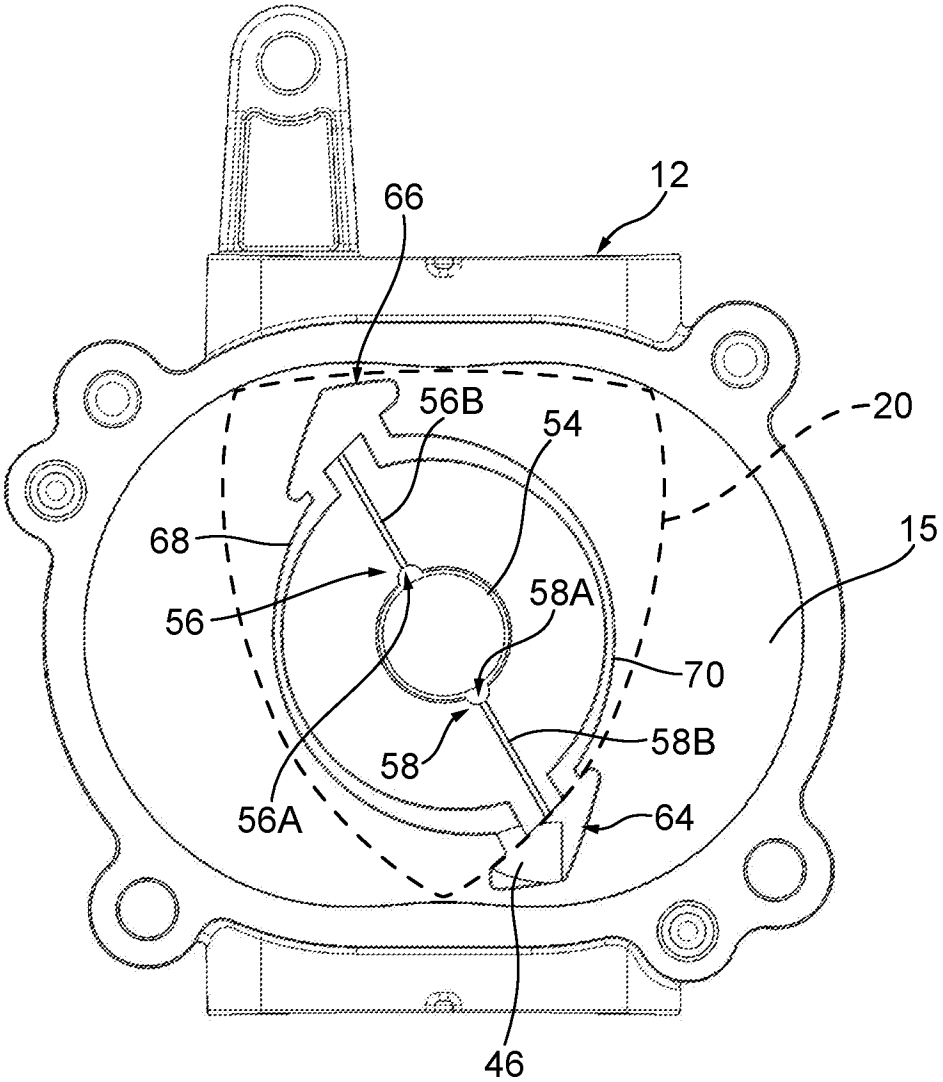
FIG. 26 is a front view of the housing of the vacuum pump of FIG. 1, showing inlets and outlets and an internal channel in accordance with one embodiment of this disclosure.

The feed channels 56, 58 may also each optionally include a second channel portion 56B, 58B that is machined into an inside of the back wall 15 (see, e.g., FIG. 26 and FIG. 28), in accordance with an embodiment. For example, the channel portions 56B, 58B may be provided or machined to extend radially outwardly along an interior wall (e.g., interior of back wall 15) of the housing towards the chamber inlet(s). Accordingly, the second channel portions 56B, 58B are positioned beneath the rotor 20 (or below or behind the rotor) when the rotor is assembled in the housing 12. The portions 56B, 58B may extend in a generally diagonal direction and radially outwardly along the housing interior, as shown in FIGS. 26 and 28, for example. The second channel portions 56B, 58B are fluidly connected to the first channel portions 56A, 58A. Specifically, the second channel portions 56B, 58B extend radially between the opening 54 and chamber channels 56A, 58A and the respective chamber inlets 66, 64 (respectively). The second channel portions 56B, 58B are designed to draw lubricant to the chamber inlets 66, 64 (respectively), so that the lubricant is suctioned (via vacuum force) into the corresponding chamber as it expands and the rotor 20 rotates. The lubricant aids in sealing the chambers at the apices of the rotor 20 and the clearances at the end faces of the rotor 20.

During operation of the pump 10, pressurized lubricant is fed through path 60 to the main drive shaft 34 via opening 61A, to lubricate the shaft. From the drive shaft 34, it drains out of the journal into connections, i.e., feed channel portions 56, 58, towards the inlet area(s), via vacuum force. The lubricant is then sucked from the vacuum into the pump housing/internal chamber. Accordingly, the input lubricant moves axially relative to the drive shaft 34 and then radially relative to a back face of the rotor 20 and into the housing 12.

In another embodiment, shown in FIGS. 32-44, a two lobed rotor design is implemented in an epitrochoidal vacuum pump 10A. For purposes of clarity and brevity, like elements and components throughout the Figures are labeled with same or similar designations and numbering as discussed with reference to FIGS. 1-31. Thus, although not discussed entirely in detail herein, one of ordinary skill in the art should understand that various features associated with the pump 10A of FIGS. 32-44 are similar to those features previously discussed. Additionally, it should be understood that the features shown in each of the individual figures is not meant to be limited solely to the illustrated embodiments. That is, the features described throughout this disclosure may be interchanged and/or used with other embodiments than those they are shown and/or described with reference to.

Figure 44:
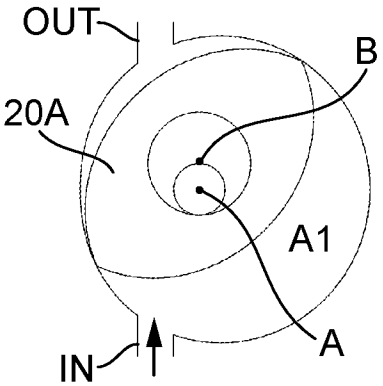
Figure 45:
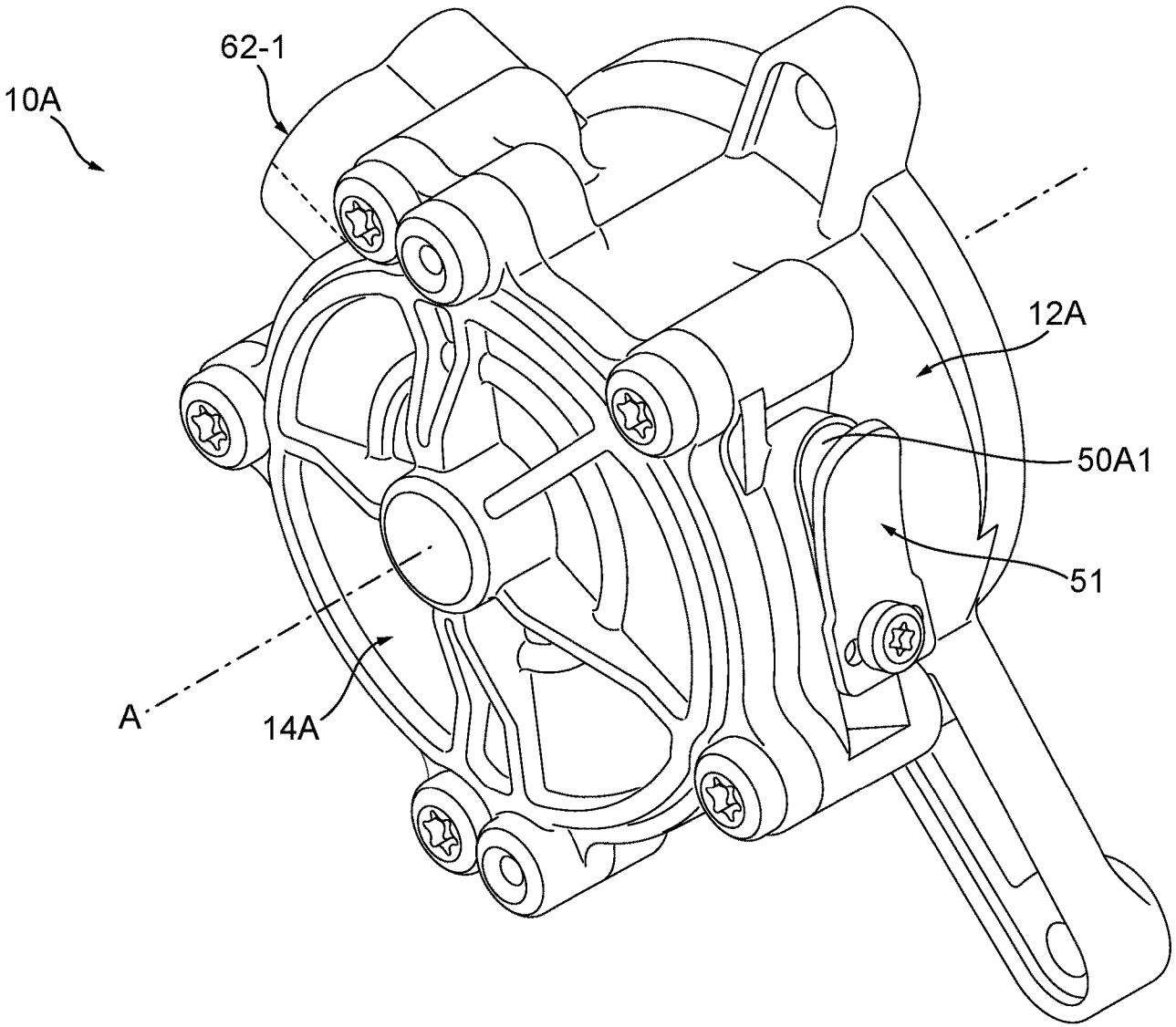
FIG. 45 is an isometric views of a front of a vacuum pump in accordance with yet another embodiment of this disclosure.
Figure 46:
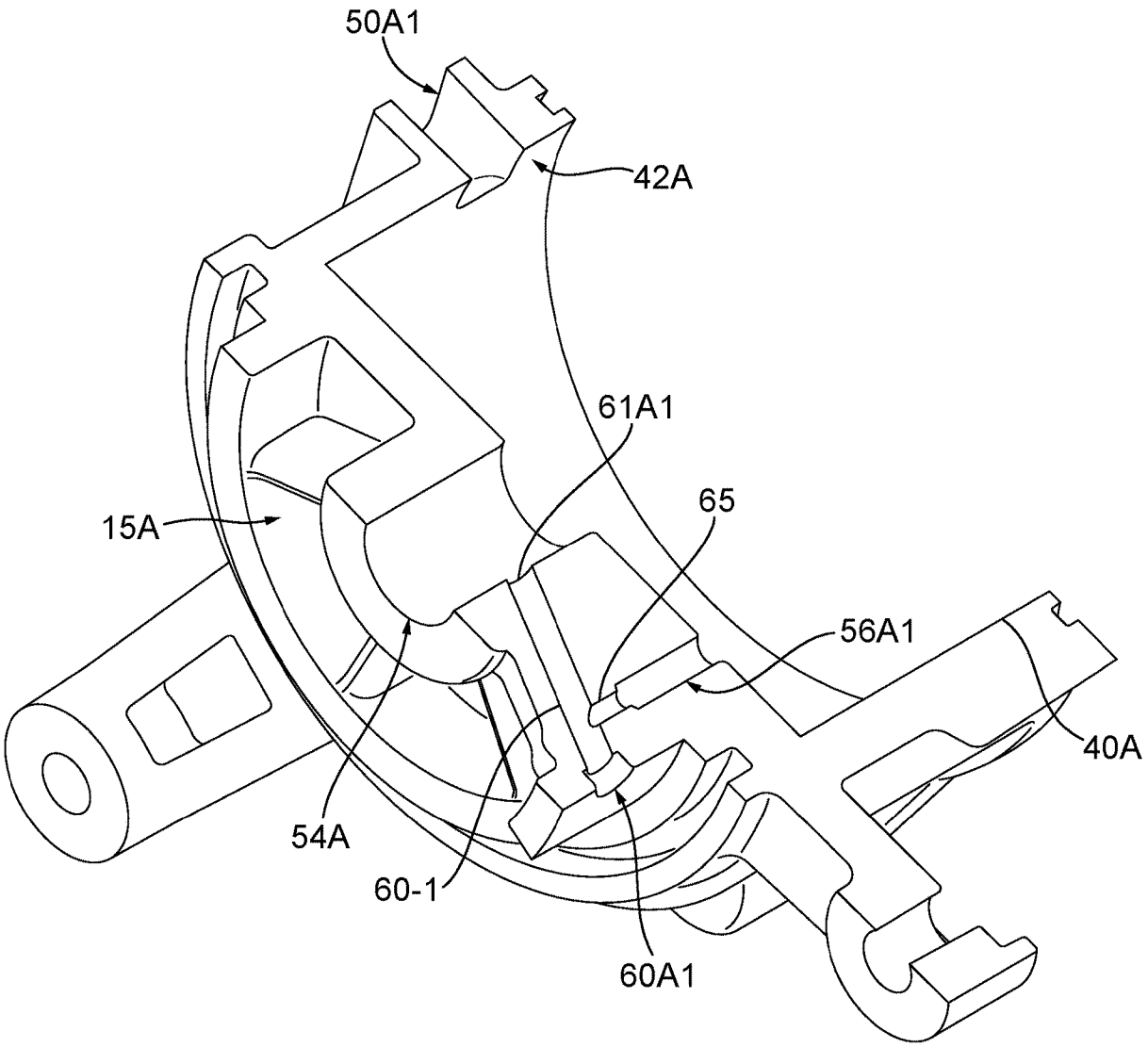
FIG. 46 is a cross sectional view of the vacuum pump of FIG. 45.

Turning now to the illustrative embodiment of FIGS. 32-44, shown is an epitrochoidal vacuum pump 10A that utilizes a two lobed rotor 20A, one inlet 62-1, and at least one outlet provided in a housing 12A. For illustrative purposes only, the vacuum pump 10A is illustrated with two openings 50A1 and 50B1 that connected to passageways that form the single outlet of the pump 10A. The openings 50A1 and 50B1 may be positioned adjacent or next to each other to provide another channel and larger area for expulsion of air, effectively increasing the cross-sectional area of the outlet port. This may also assist in reducing resistance(s) during expulsion, for example. Opening and closing timing of the openings 50A1 and 50B1 via their associated reed valves 51A is configured to be identical such that they act as one outlet for the housing 12A. In another embodiment, as illustrated in FIGS. 45-46, a single outlet 50A1 may be provided in housing 12A. The inlet port or inlet 62-1 may be a radially positioned inlet, as shown (radial relative to axis A).

A single epitrochoidal working chamber is implemented in the housing 12A of the disclosed vacuum pump 10A (see, e.g., FIG. 34) and has a chamber volume. For each rotor revolution, each chamber fulfills two evacuation cycles. Accordingly, the total evacuation capacity per pump shaft rotation in the disclosed vacuum pump 10A is defined as: single chamber volume×1 (since there is one chamber)×2 (evacuation cycles per rotor revolution)/2 (rotor speed reduction to shaft speed); therefore, the total evacuated capacity is 1*single chamber volume.

In vacuum pump 10A, the gear ratio of the guide gear to the rotor gear is 1/2.

The disclosed vacuum pump of FIGS. 32-44 has an internal channel machined into the housing 12A that breaks or splits off the main feed to the journal/bearing (before reaching the bearing) and is designed to feed or draw lubricant (e.g., oil) from its drive shaft and directly into chamber 40A of the housing 12A, as shown in and described later with respect to FIG. 40, such that the lubricant is sucked or pulled into the chamber as it expands. The vacuum pump rotor speed is reduced by factor 1/2 as compared to shaft speed.

As understood by one of ordinary skill in the art, the rotor speed, length and mass are relevant for the load on the rotor tips. The load on the rotor tips is the restricting parameter for the pump speed due to wear. For identical radial dimensions, the herein disclosed epitrochoidal pump 10A provides a relative tip speed that is reduced by 50% as compared to a standard single vane pump (drive ratio of 1/2 of rotor to drive shaft). In addition, the rotor of pump 10A is guided by the excenter, and only the mass of the moveable vane tips create vane tip load. Due to these two parameters, the speed of the drive shaft can be increased by more than 50% compared to a typical vane pump. As such, the disclosed pump 10A provides the opportunity to propose a number of applications, from a sump vacuum pump for gasoline engines up to high speed applications.

Figure 32:
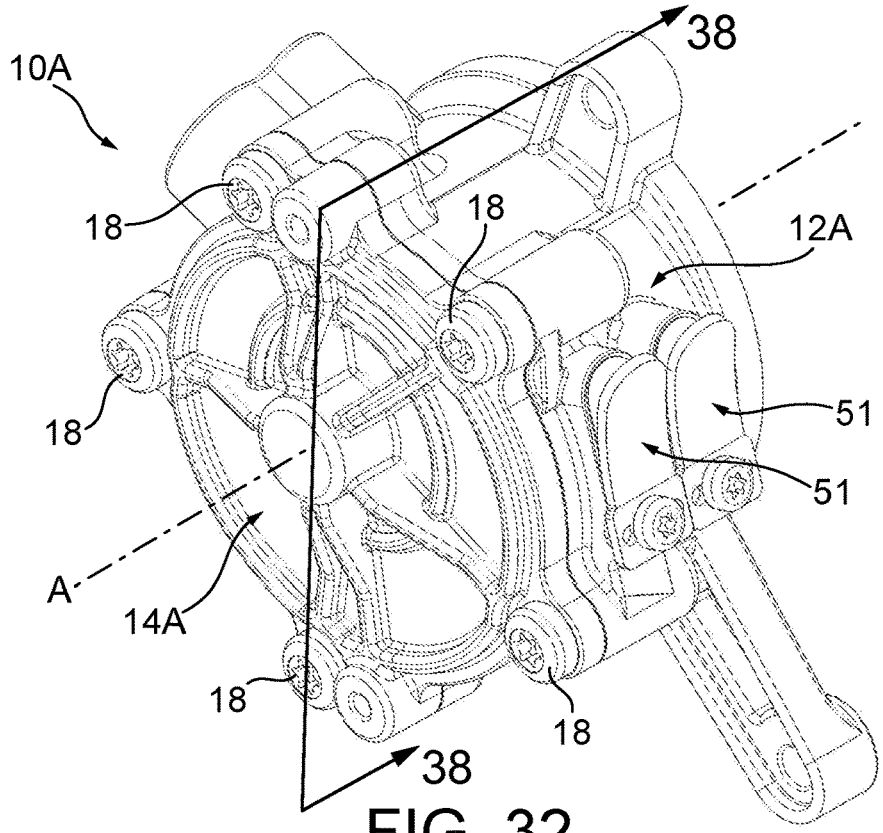
FIGS. 32 and 33 are isometric views of a front and a back, respectively, of a vacuum pump in accordance with another embodiment of this disclosure.
Figure 33:
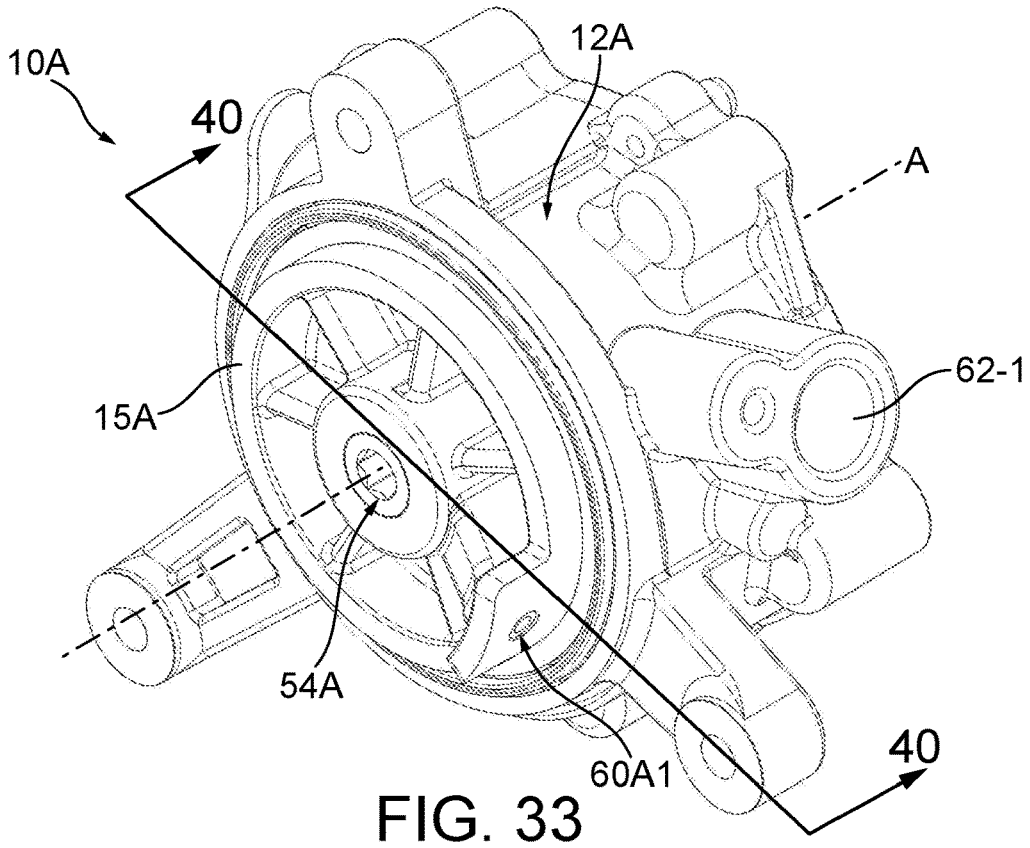

FIGS. 32-33 show a front and a back of epitrochoidal vacuum pump 10A, in accordance with an embodiment of this disclosure. Vacuum pump 10A may be a "wet" vacuum pump, i.e., a pump that intakes air for pressurization and also receives/intakes a small amount of lubricant or oil into its housing 12A, or a dry vacuum pump, i.e., the pump 10 may be run without adding lubricant to the housing 12. For explanatory purposes only, the pump 10A is described as using lubricant. The lubricant is added to the housing 12A via feed channel 56A (see FIG. 40) for various purposes, e.g., to seal vacuum chambers at apices/tips of its rotor 20A as it is rotated therein, which are described in greater detail later.

Figure 34:
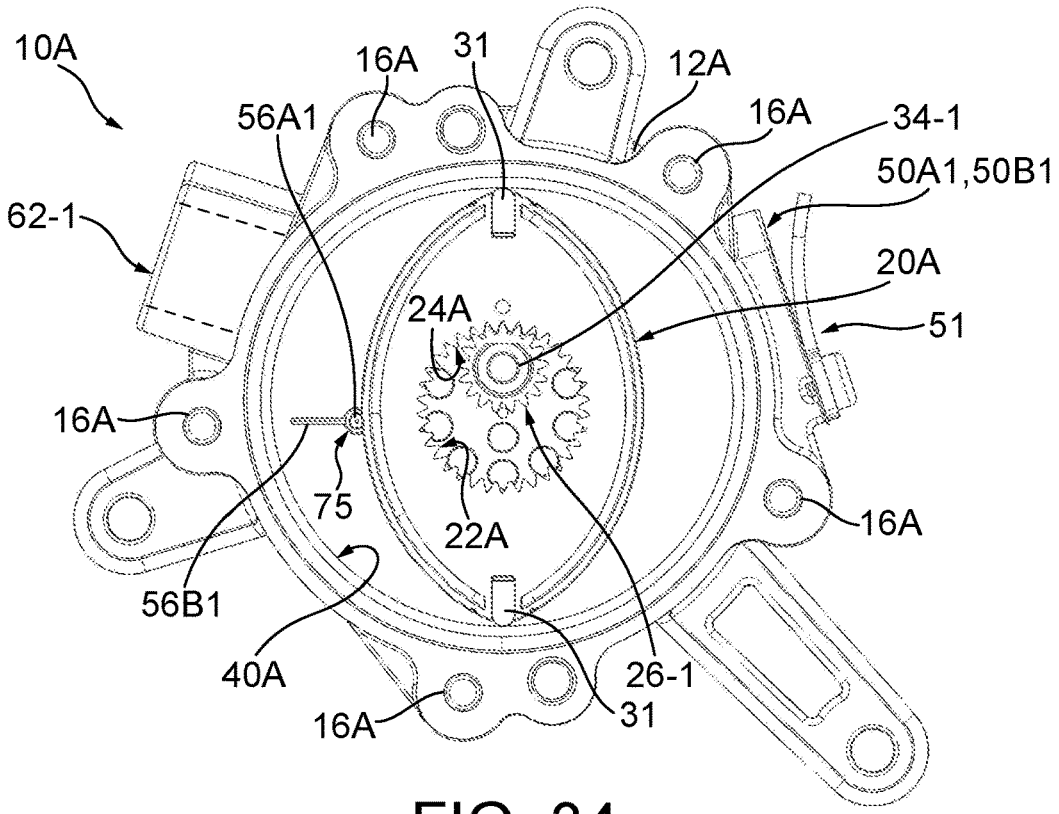
FIG. 34 is a schematic front view of the vacuum pump of FIGS. 32-33, with the cover removed, showing parts provided in its housing, in accordance with an embodiment of this disclosure.

As shown in FIGS. 34 and 39, the housing 12A includes a chamber 40A having an internal space defined by a surrounding wall 42A. In one embodiment, the internal space is appears circular or substantially circular. However, it is an epitrochoidally generated shape. The closeness in appearance to a circle is due to the distance between the eccentric point on the rolling circle that plots the epitrochoid and the center of that rolling circle being smaller. More distinct shapes can be generated as that distance increases. The surrounding wall 42A is flanked by a front wall or cover 14A and a back wall 15A. A flanged portion may be provided on the housing 12A that includes a number of openings 16A thereon for alignment with openings of cover 14A. Alignment of the openings of the cover 14A and housing 12A allows for insertion of fasteners 18 (e.g., bolts, as shown in FIGS. 32 and 39) to secure the cover 14A to the surrounding wall 42A, thus enclosing parts (e.g., rotor 20A) within the housing 12A and forming a vacuum chamber therein. One or more inlayed seals 28A may be provided along edges of the flange/cover 14A to assist in sealing the housing 12A and cover 14A. Another seal, such as fixture seal 45 (see FIGS. 38 and 39), may be provided on an outside of the housing 12A. Pins 19 and/or other fasteners 18A may be provided for insertion through designated openings in parts of the housing as well, and used to secure the pump 10 to or within a structure (e.g., vehicle).

The shape of the internal space of the housing 12A provides an epitrochoidal space for rotating movement of rotor 20A. The rotor 20A is rotatably received within the internal space of the chamber 40A (see FIG. 34) and is shaped with a number of edges that conjugate with the shape of the epitrochoidal internal space (i.e., the edges or lobes of the rotor move towards the epitrochoidal form/wall, and the rotor tips or corners (e.g., seals 31) contact and slide along the epitrochoidal form/wall). The chamber 40A of the housing 12A is a single working chamber that is varied in size by the rotor 20 as it rotates and orbitally revolves within the housing 12A along the surrounding wall 42A. During rotation, each side surface of the rotor 20A is brought closer to and then away from the wall 42A of the housing, without fully contacting the wall 42A (e.g., due to manufacturing clearances). In an embodiment, one side may substantially contact the wall 42A, while the other is open to the working chamber of the pump. Corners or apices of the rotor 20A are guided along the wall 42A in a sliding contact manner (e.g., via seals 31) during rotation of the rotor 20A. In the exemplary illustrated embodiment herein, (as a result of using the illustrated two lobed rotor 20A with inner envelope design) there is a single working chamber formed in chamber 40A. The chamber is designed to input (or aspirate) and output (or expulse or expel) air using chamber inlet 62-1 and chamber outlet (defined by openings 50A1, 50B1) provided in the housing 12A. Further details regarding a rotational cycle are described later with reference to FIGS. 41-44.

The body of the rotor 20A may have a substantially ovular shape that is similar to an egg, with two sides having convex, bow-shaped flanks (see, e.g., FIG. 39) forming its outer walls or edges, in accordance with an embodiment. The shape and/or design of the lobes of the rotor 20A, i.e., its outer walls, may include bowed edges (convex or concave configurations), substantially straight edges, or curved edges, for example. The shape and/or design of the surrounding wall 42A in housing 12A (that forms its internal space) may be ovular or curved. In one embodiment, the shape and/or design of the rotor 20A and its lobes/outer edges may be dependent upon the shape of the internal space formed by the surrounding wall 42A of housing 12A.

Rotation of the rotor 20A is performed eccentrically about an axis A and is implemented by an internally toothed opening 22A or portion integrated in the rotor 20A, an externally toothed guide sprocket 26-1, and a drive shaft 34-1. FIG. 39 shows an exploded view indicating an assembly of the rotor 20A, guide sprocket 26-1, and shaft 34A that may be used in the vacuum pump 10A. The rotor 20A may be formed from a number of materials (e.g., steel, sinter, powdered metal, plastic, etc.,) and manufactured in any number of ways and should not be limited.

For example, a body of the rotor 20A may have an opening 22A in its center that is internally toothed for receipt of the guide sprocket 26-1 therein. The central opening 22A may be defined by a plurality of radially extending female teeth 24A on the interior thereof. The guide sprocket 26-1 is received within the central opening 22A. The guide sprocket 26-1 may have a plurality of radially extending male teeth 30-1 (see FIGS. 38 and 39) on the exterior thereof that mesh with and guide movement of the opening 22A (when the rotor 20A is rotated by the drive shaft 34-1). The guide sprocket 26-1 is designed to be fixed in place on the underside or bottom of the cover 14A (see FIG. 38). The guide sprocket may have a shaft extension portion 26A1 that extends forwardly from the teeth 30-1, that can be press-fit into a corresponding portion or receiving area 14*a*2 within the cover 14A (see FIGS. 35 and 38). The extension portion 26A1 has a drive shape (e.g., a flat portion thereon) for proper alignment and positioning within the area of the cover, allowing the guide sprocket 26-1 to be rotationally fixed in location. This ensures correct movement of the rotor 20A as it is driven by the drive shaft 34-1. That is, the rotor 20A moves around the fixed guide sprocket 26-1. Specifically, the rotor 20A is guided around the fixed guide sprocket 26-1 via teeth on opening 22A meshing and engaging with the teeth 30-1 of the guide sprocket 26-1.

Figure 38:
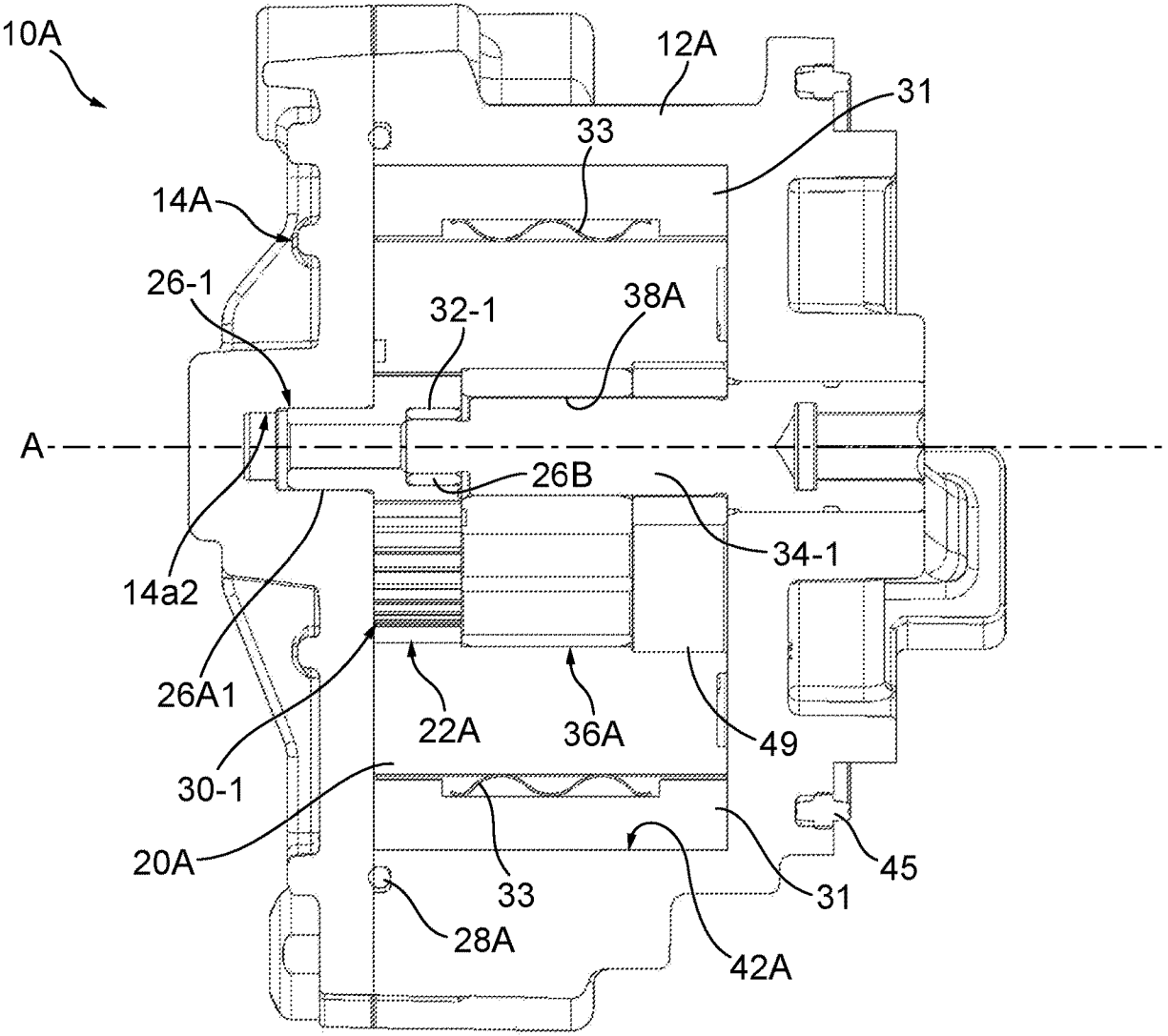
FIG. 38 is a cross sectional view of the vacuum pump taken along line 38-38 in FIG. 35, showing assembly of some parts inside the pump housing.

The rotor 20A may optionally have compression seals 31 provided at each of its tips, apexes, or corners of its body to seal and slidingly guide the rotor 20A against a periphery of the surrounding wall 42A of housing 12A. The compression seals 31 may be received within openings provided at the tips or apexes, for example (see, e.g., FIG. 39). The compression seals 31 may include one or more pieces. In one embodiment, a spring or spring-like material may be provided within the openings along with the seals 31, to provide a radially outward force to the seals 31 and at the tips of the rotor 20A. For example, as shown in FIGS. 38 and 39, wave springs 33 may be provided in the openings along with the seals 31 in the apexes. In another embodiment, flat springs or leaf springs may be used with seals 31 and provided in the apexes of the rotor 20A.

The drive shaft 34-1 is rotated by a driver (e.g., motor) about axis A. The driver may be connected to the drive shaft 34-1 through an opening 54A in the back of the housing 12A (see FIG. 33), and secured using a connector or seal. The drive shaft 34-1 is designed to extend through the rotor 20A towards cover 14A, as shown in FIG. 38. An end of the drive shaft 34-1 is received within a hole 32-1 of the guide sprocket 26-1 and secured from rotating therein by a bushing 26B, for example. To implement eccentric movement of the rotor 20A about axis A within the chamber 40*a* of housing 12A, an eccentric rotation bearing 36A is provided. In an embodiment, a spacer 49 (see FIG. 39) is provided to axially locate the eccentric bearing 36A, e.g., during the press fitting of the pieces (i.e., drive shaft 34-1, bearing 36A, rotor 20A) together. The spacer 49 reduces the size and weight of the eccentric bearing 36A to thereby improve balancing of the bearing 36A.

In addition to receiving the drive shaft 34-1 therethrough, the opening 22A in the body of the rotor 20A is designed for receipt of the eccentric rotation bearing 36A. Eccentric rotation bearing 36A may have its own receiving opening 38A for positioning of the drive shaft 34-1 therethrough. To connect the drive shaft 34-1 with the bearing 36A, the drive shaft may be press-fit into the receiving opening 38A (see FIG. 38). The eccentric rotation bearing 36A rotatably fixes the rotor 20A relative to the drive shaft 34-1, while providing eccentric rotation of the rotor 20A about axis A as it is driven. A diameter d3 of the opening 22A (see FIG. 39) is sized to receive the eccentric rotation bearing 36A therein in close relation with sufficient clearance for stable rotation, for example. Accordingly, the diameter d3 in the body of the rotor 20 and a diameter D1 of the eccentric rotation bearing 36A may be substantially similar.

FIG. 39 also shows drive shaft 34-1 may include a stepped configuration (first shaft portion or end 34A, a second shaft portion 34B, and a third shaft portion 34C (an opposite end to 34A), each having successively increasing diameters D2, D3, and D4) for assembly with the rotor 20A, such as previously described above with reference to the pump 10 as shown FIGS. 13, 15, and 16.

Accordingly, assembly of the parts as generally shown in FIGS. 38 and 39, along with the drive shaft 34-1 therethrough, provides eccentric rotation of the rotor 20A within the chamber 40A of the housing 12A during use of the pump 10. During such rotation, the working chamber 40A is designed to intake air, compress, and exhaust pressurized air from the pump 10A.

The aforementioned vacuum inlet 62-1 (see, e.g., FIGS. 33 and 37) is provided for inputting air into the housing 12A. The vacuum inlet 62-1 includes an input passageway that extends radially through a side of the housing 12A (into the chamber 40) and receives (pulls via vacuum) air through an opening provided on the side of the housing 12. Air is communicated and drawn through the passageway and into at least one radial inlet port 46A (e.g., see FIGS. 35, 37, 39). Axial inlet port 46A fluidly connects to the inside of the chamber 40A. Inlet 62-1 and its port 46A selectively draws and delivers air in the radial direction under negative pressure (vacuum), dependent upon the position of the rotor 20A.

Figure 37:
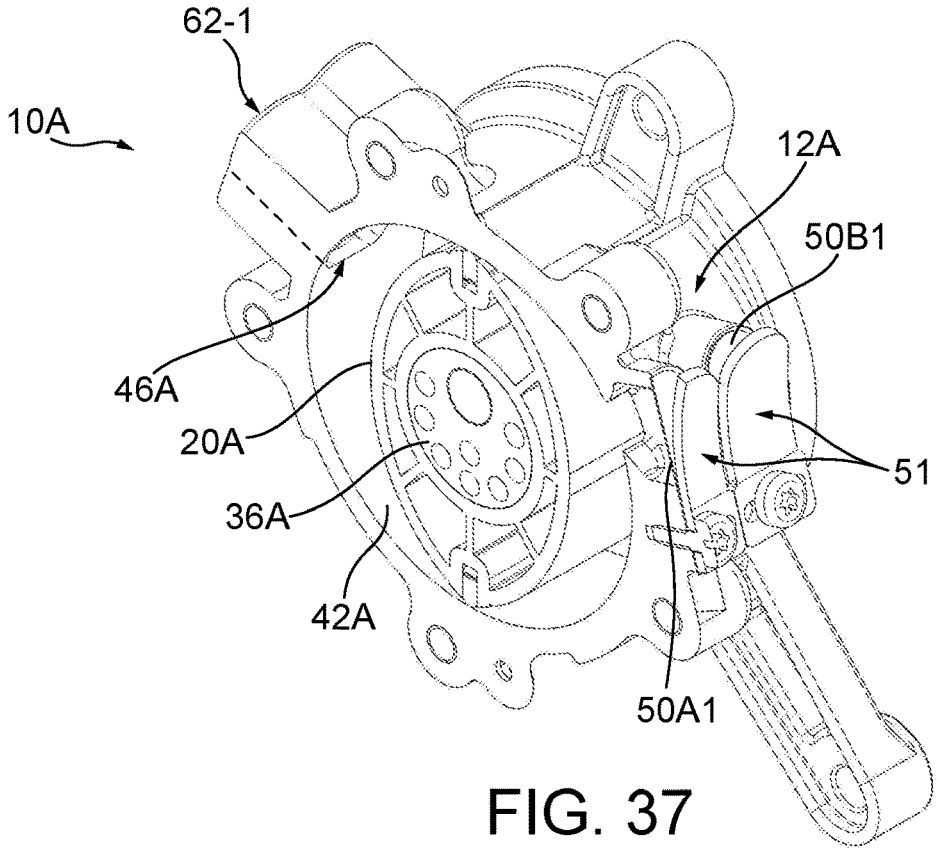
FIG. 37 is an isometric view of the cross-sectional view of FIG. 36.

During one rotor revolution, there are two evacuation cycles completed for the working chamber 40A. In the illustrated embodiment of pump 10A, the chamber needs to be equipped with minimum of one inlet passageway/channel and one outlet passageway/channel. A single outlet, formed by two passageways defined by openings 50A1 and 50B1 in the exemplary illustrated embodiment, output or expel air under positive pressure from the chamber 40A as the rotor 20A is rotated under normal or forward rotation. The outlet passageway (or channel) and openings extend radially relative to axis A, in accordance with an embodiment. As shown in FIG. 37, the openings 50A1, 50B1 of the outlet may be provided through the surrounding wall 42A. The outlet is designed in a way that the cross sectional area allows a sufficient flow without restriction (e.g., the passageway of each of the outlets may expands from a smaller port positioned on the surrounding wall 42A of the housing 12A). The size of the outlet may be determined based upon pump displacement and exhaust speed. The radial positioning of the outlet allows air to flow out of the chamber from inside housing when the chamber volume is the smallest during rotation of the rotor 20A (e.g., when the rotor 20A is positioned as shown in FIG. 44, it is still connected to outlet).

Figure 35:
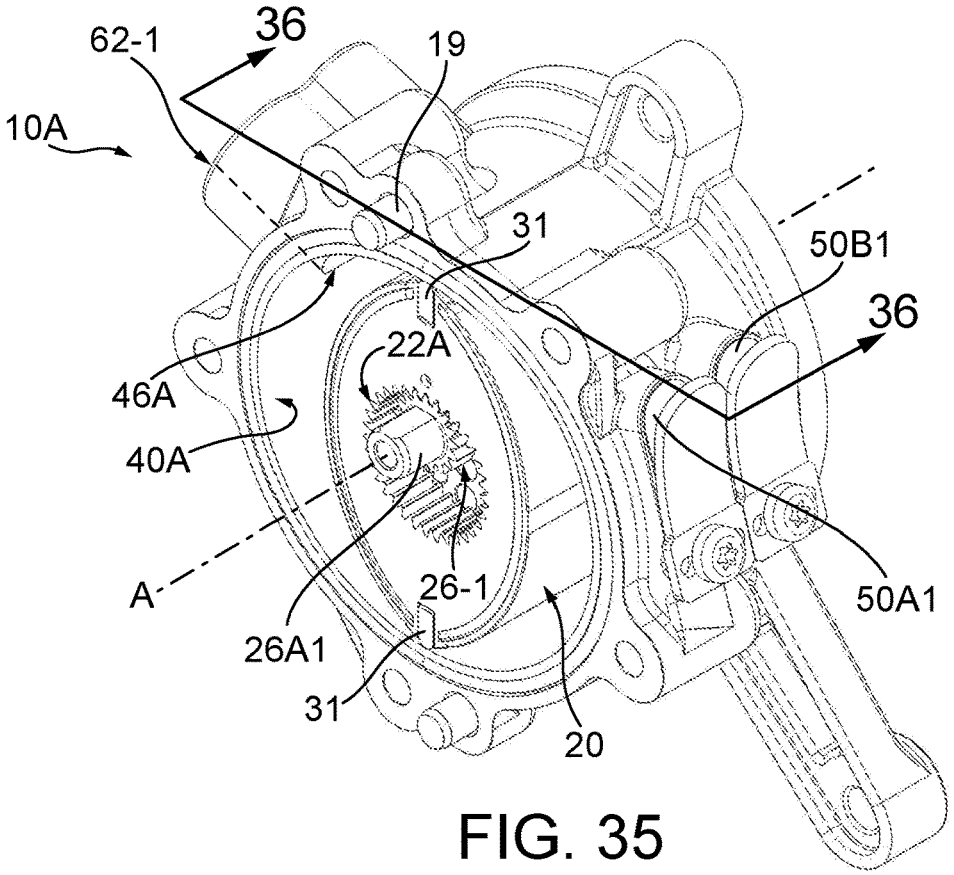
FIG. 35 is an isometric view of the view shown in FIG. 34.
Figure 36:
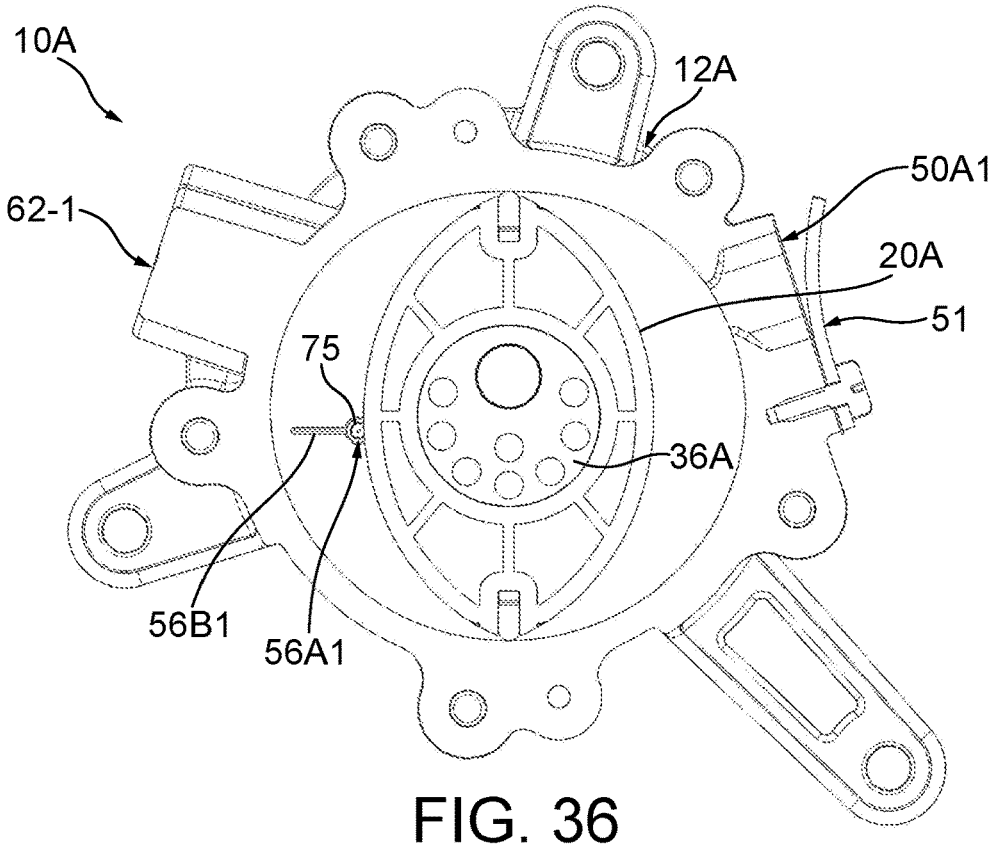
FIG. 36 is a cross sectional view of the vacuum pump taken along line 36-36 in FIG. 35, showing assembly of some parts inside the pump housing.

In accordance with an embodiment, the outlet openings 50A1, 50B1 of the passageways may each be equipped with reed valve 51. As shown in FIGS. 32 and 35, for example, a reed valve 51 may be provided on each opening 50A1, 50B1.

As previously noted, although two passageways and openings are shown, in accordance with an embodiment, a single passageway, outlet, and reed valve 51 may be provided in housing 12A.

In accordance with an embodiment, the outlet channel timing defines the shape of the outlet channel geometry (e.g., the outlet needs to open after maximum chamber volume is achieved).

Although the outlets are positioned radially in the illustrated embodiments, in one embodiment, the outlets may be positioned in an axial direction. Still, positioning of the outlets in the radial direction may be easier during casting, and further allows for use and easier positioning of the reed valves 51.

FIGS. 41-44 are schematic illustrations representing steps of a cycle as the two-lobe rotor 20A performs a single (counter-clockwise) revolution in the housing 12A of the vacuum pump 10A. The rotor 20A is rotated eccentrically around the axis A in a counter-clockwise manner. For each rotor rotation, there are two evacuation cycles completed for the chamber 40A. Only one evacuation cycle is shown in FIGS. 41-44 because the rotor has only completed one-half of a rotation. Center A is the center of the drive shaft 34-1, which also equals the center of the guide gear (guide sprocket 26-1). Center B is the center of the rotor 20A. These Figures generally designed to show operation of pump 10A and the vacuum chamber 40A during rotation of the rotor 20A around and along the surrounding wall 42A. The positioning of the chamber inlet and outlet as shown in FIGS. 41-44 is for descriptive purposes only and is not intended to be structurally limiting.

Figure 41:
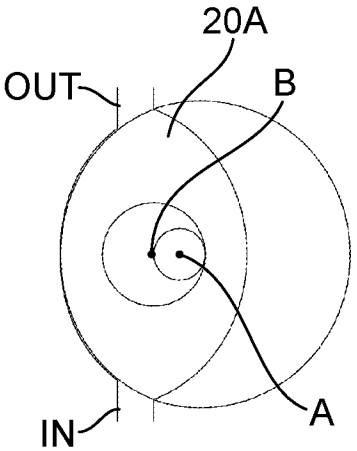
FIGS. 41-44 illustrate steps of a cycle as the rotor performs a single revolution in the vacuum pump of FIG. 32.
Figure 42:
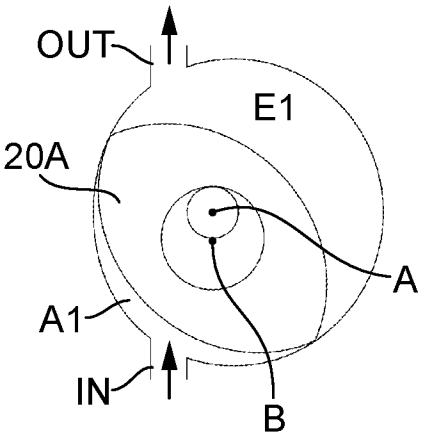
Figure 43:
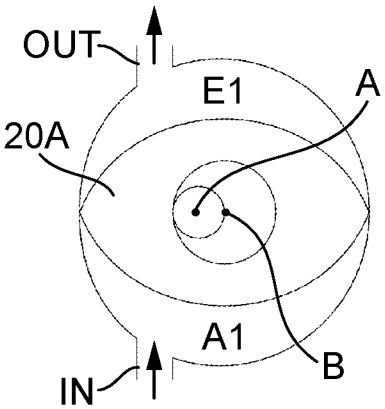

When the rotor 20A is in a first position, or top dead center, such as shown in FIG. 41, the inlet IN (e.g., 62-1 and 46A) and outlet OUT (e.g., 50A1) are closed or sealed by the substantial engagement of the rotor 20A sides and contact of its tips (e.g., via seals 31) with the surrounding wall 42A in the chamber. The chamber 40A has a maximum volume. When driven to a second position, represented in FIG. 42, the rotor 20A opens the inlet IN and outlet OUT. Air is expulsed (E1) through the outlet OUT and pulled in via inlet IN (A1). FIG. 43 shows a third position of the rotor 20A, for maximum flow and reduced chamber volume, wherein the chamber continues to expulse air through outlet OUT and receive air via aspiration (A1) through chamber inlet IN. When the rotor 20A moves to its fourth position, represented in FIG. 44 towards bottom dead center, the chamber continues to expulse air through outlet OUT to fully exhaust the chamber, while continuing to draw air into A1 from chamber inlet IN.

The gear ratio between rotor 20A and the fixed guide sprocket 26-1 in the illustrated embodiment of FIGS. 32-44 is 1/2, and the drive ratio between the rotor 20 and drive shaft is also 1/2. The difference in the two centers is defined by the pump eccentricity. This drive ratio, and the eccentricity of center A (i.e., the center of the drive shaft) to a center B (i.e., the center of the rotor), results in the eccentric movement of the rotor 20A around guide sprocket 26-1 and within the epitrochoidal housing 12A. Accordingly, for every 360° (degrees) in drive shaft rotation, the rotor 20A rotates 180° (degrees).

The chamber inlet IN or 62-1 may receive input air for delivery in a number of ways. In accordance with one embodiment, air may be pulled into inlet 62-1 through passageway 62 through radial inlet port 46A and directly into chamber 40A via negative pressure. The channel or passageway of inlet 62-1 may be machined into a side of the wall of the housing 12A such that it is substantially across or opposite to a passageway of the outlet, in accordance with one embodiment. The chamber inlet and outlet of pump 10A may be positioned in any number of ways. The configurations for establishing input of air to the housing 12A as shown in the Figures are exemplary and not intended to be limiting.

In addition to drawing air (via passageway and inlet 62-1) into the housing 12A during rotation of the rotor 20A, the vacuum pump 10A may be designed to feed or draw lubricant (e.g., oil) through a fluid inlet (60A1) to the drive shaft 34-1 to create a fluid bearing and into the chamber 40A of the pump to selectively feed oil into the housing 12A to provide sealing at the apices of the rotor 20A (i.e., when used as a "wet" vacuum pump). Thus, the vacuum pump 10A may further include a fluid inlet path 60-1 and lubricant feed channel 56A1, shown in FIG. 40, for example, for drawing a lubricant (e.g., oil) into the housing 12A and communicating said lubricant to both the drive shaft and into the internal space of the housing (chamber 40A). A fluid inlet opening 60A1 (see FIGS. 33 and 40) to the fluid inlet path 60-1 may be provided in the back wall 15A of the housing 12A, for example. The embodiment of FIG. 46 also shows an example of using this type of inlet opening 60A1 and inlet path 60-1 in a pump with one outlet 50A1. The fluid inlet path 60-1 is configured to draw lubricant from opening 60A1 and through opening 61A1 to the opening 54A for the drive shaft 34-1, as it is subject to a pressure differential generated in the internal space, and thus is also referred to as "drive shaft channel 60-1" herein. Accordingly, lubricant may be delivered into opening 60A1, through inlet path of channel 60-1 and through and from opening 61A1 (see FIG. 40) and thus around the drive shaft 34-1 to create a fluid bearing as the drive shaft 34-1 rotates about axis A.

Figure 40:
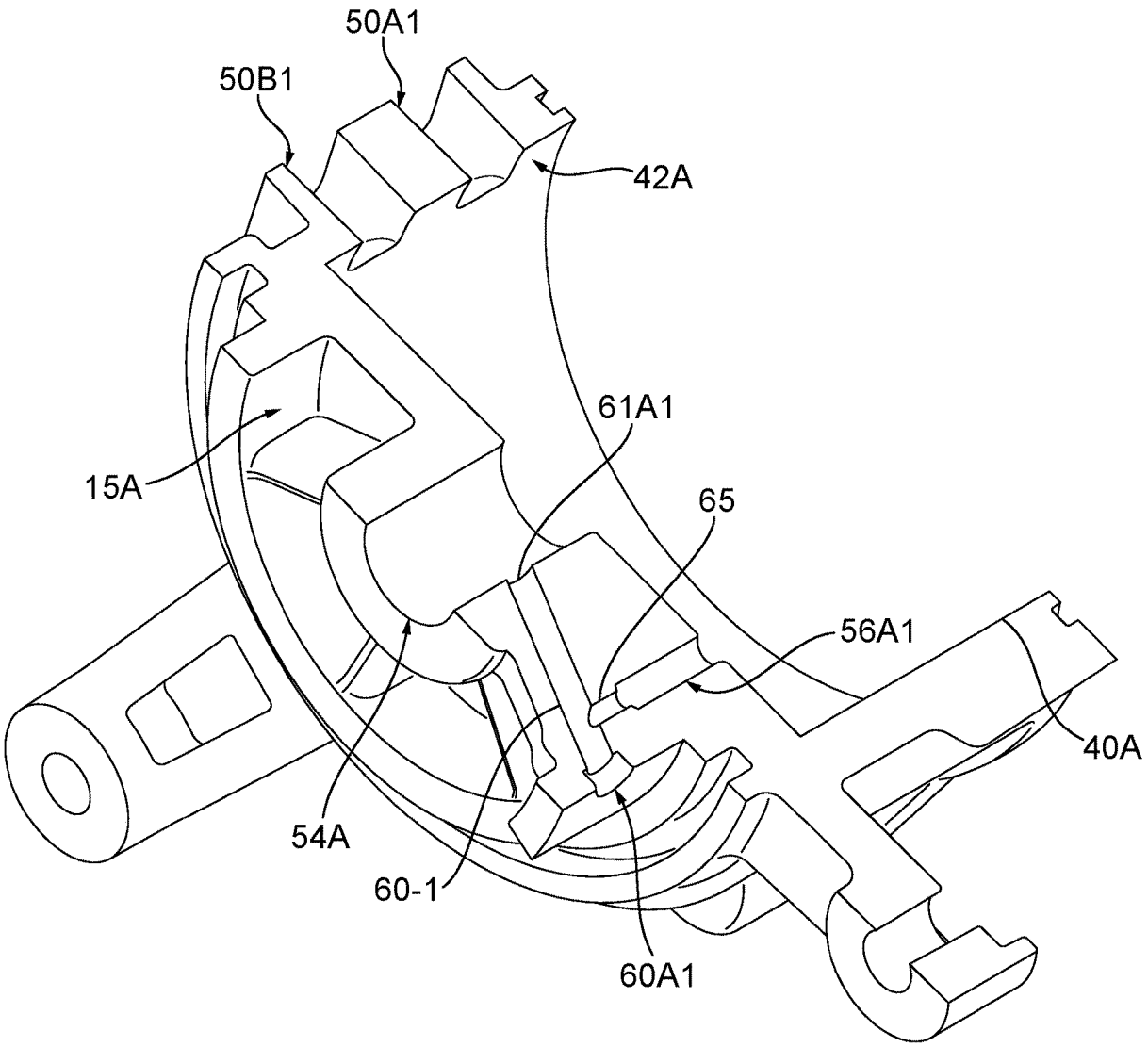
FIG. 40 is a cross sectional view of the vacuum pump taken along line 40-40 in FIG. 33, showing internal channels inside the pump housing.

As shown in FIG. 40, for example, the fluid inlet path of the drive shaft channel 60-1 may be a channel or tunnel that extends through back wall 15A, i.e., positioned below or behind the rotor 20A, to opening 54A for the drive shaft 34-1. It leads lubricant to the opening 54A for the drive shaft 34-1 for lubrication thereof. In one embodiment, as shown in FIG. 40, for example, the drive shaft channel 60-1 extends radially through a wall (e.g., back wall 15A) of the housing for drawing lubricant to the drive shaft 34-1.

A lubricant feed channel, or chamber channel 56A1, also pulls pressurized lubricant from the inlet 60A and inlet path of channel 60-1. That is, the pressure differential (under negative pressure) generated in the internal space of the chamber 40A draws pressurized lubricant through the fluid inlet 60A1 and into channel 56A1, and into the housing. The feed or chamber channel 56A1 is also machined in the back wall 15A. The chamber channel 56A1 is positioned beneath (or below or behind) the rotor 20A when the pump is assembled. The path of the chamber channel 56A1 extends in an axial direction adjacent to the drive shaft 34-1 (see FIG. 40) through a wall (e.g., back wall 15A) of the housing 12A, in accordance with an embodiment, for drawing lubricant into the internal space of the chamber 40A. Thus, lubricant is drawn towards the internal space of the chamber as well as further around the drive shaft 34-1 to create a fluid bearing therearound.

In one embodiment, the chamber channel 56A1 is positioned axially while the drive shaft channel 60-1 extends in a radial direction in the housing.

In an embodiment, a junction 65, shown in FIG. 40 (and also FIG. 46), is provided in the housing 12 to directly connect the drive shaft channel 60-1 and the chamber channel 56A1. The drive shaft channel 60-1 is formed in the housing 12 to extend from the fluid inlet 60A1 to opening 61A1 connected to opening 54A receiving the drive shaft 34-1, and the chamber channel 56A1 is formed in the housing to extend from the junction 65 to (an opening at) the internal space of the chamber 40A. Accordingly, the fluid inlet 60A1 may be used to deliver lubricant to channel 60-1 and the junction 65 to thus feed lubricant to both the opening 54A for the drive shaft 34-1 and the chamber channel 56A1 for the chamber 40A.

In an embodiment, a lubricant feed nozzle 75 (see FIGS. 34 and 36) is optionally provided on an inside of the back wall 15A. The lubricant feed nozzle 75 may be connected to an optional second channel portion 56B1 that machined into the housing (e.g., inside of the back wall 15A) and fluidly connected to the chamber channel 56A1. For example, channel portion 56B1 may be provided or machined to extend radially outwardly along the interior wall of the housing, towards the chamber inlet. The portion 56B1 may extend radially from an opening for chamber channel 56A1. As such, channel portion 56B1 and nozzle 75 may be positioned beneath the rotor 20A (or below or behind the rotor 20A) when the rotor is assembled in the housing 12A. In an embodiment, a nozzle 75 need not be provided, and only channel portion 56B1 is provided. With or without nozzle 75, the channel portion 56B1 may be designed to draw lubricant into the chamber 40A so that lubricant is suctioned (via vacuum force) into the working chamber as it expands and the rotor 20A rotates. The lubricant aids in sealing the chamber at the apices of the rotor 20A and the clearances at the end faces of the rotor 20.

Accordingly, during operation of the pump 10A, lubricant may be delivered from opening 60A1 into the path of drive shaft channel 60-1 and thus around the drive shaft 34-1 to create a fluid bearing as the drive shaft 34 rotates about axis A. At the same time, lubricant may be pulled from path of channel 60-1, through junction 65, into the feed or chamber channel 56A1 under suction and into the chamber 40A, optionally via channel portion 56B1 and nozzle 75, for lubricating internal space of chamber 40A, assisting movement of the rotor 20A about surrounding wall 42A, and sealing the chamber at the apices of the rotor 20A. As such, the input lubricant moves both radially relative to the drive shaft 34-1 and axially relative to a back face of the rotor 20A and into the housing 12A.

In accordance with an embodiment, it is envisioned that a separate lubricant/oil feed channel (not shown) equipped with a defined nozzle may also be provided on the pump 10. Such an additional channel may enable adjustment of lubricant, e.g., for adding lubricant depending on if the required or desired amount.

The herein disclosed vacuum pump is designed to take advantage of the benefits of an epitrochoidal design for drawing air and lubricant to the chamber(s) inside of the housing 12 under negative pressure or as a result of a pressure differential.

Use of the term "negative pressure" or "vacuum" in this disclosure may refer to a pressure differential between spaces, e.g., internal space of the housing as compared to its environment, and is not necessarily limited to an action of applying pressure or vacuum. For example, drawing air under negative pressure into the housing via an inlet in any of the herein disclosed embodiments may refer to the suction of air into the housing based on a difference in pressure in the housing, e.g., resulting from the movement of the rotor and pressure in the working chamber(s), as compared to the surrounding environment.

Additionally, it should be understood by one of ordinary skill in the art that reference to closing or sealing an inlet, an outlet, an opening, or the like, via the lobes/edges/sides of a rotor (e.g., rotor 20 or rotor 20A) should not be limited to being defined as the edges or sides of the rotor fully contacting the housing wall or fully closing or fully covering said inlet, outlet, or opening. Rather, movement of the rotor towards a wall of the housing may substantially close off an inlet, outlet, or opening of the housing, while leaving clearances or tolerances (e.g., clearance of approximately 10 microns to approximately 100 microns, both inclusive, between the wall of the housing and rotor side). At the same time, the tips/apices or seals (31) of the rotor in contact with the housing wall, to thereby limit or seal off an inlet, outlet, or opening, as understood by one of ordinary skill in the art.

In some embodiments, lubricant can be delivered to the housing and internal channels without use of separate and distinct inlets. The internal channels may, in an embodiment, be sized and positioned for reducing leak points that may affect the rotor.

Also, the number of vacuum/air inlets and outlets may be adjusted based on the epitrochoidal design that is implemented in the vacuum pump. For example, as shown, in the case of a three lobe rotor, two inlets and two outlets may be provided in the pump housing. For a two lobe rotor, one inlet and one outlet may be provided in the pump housing. A four lobe rotor design may implement three inlets and three outlets in a pump housing, for example.

Figure 47:
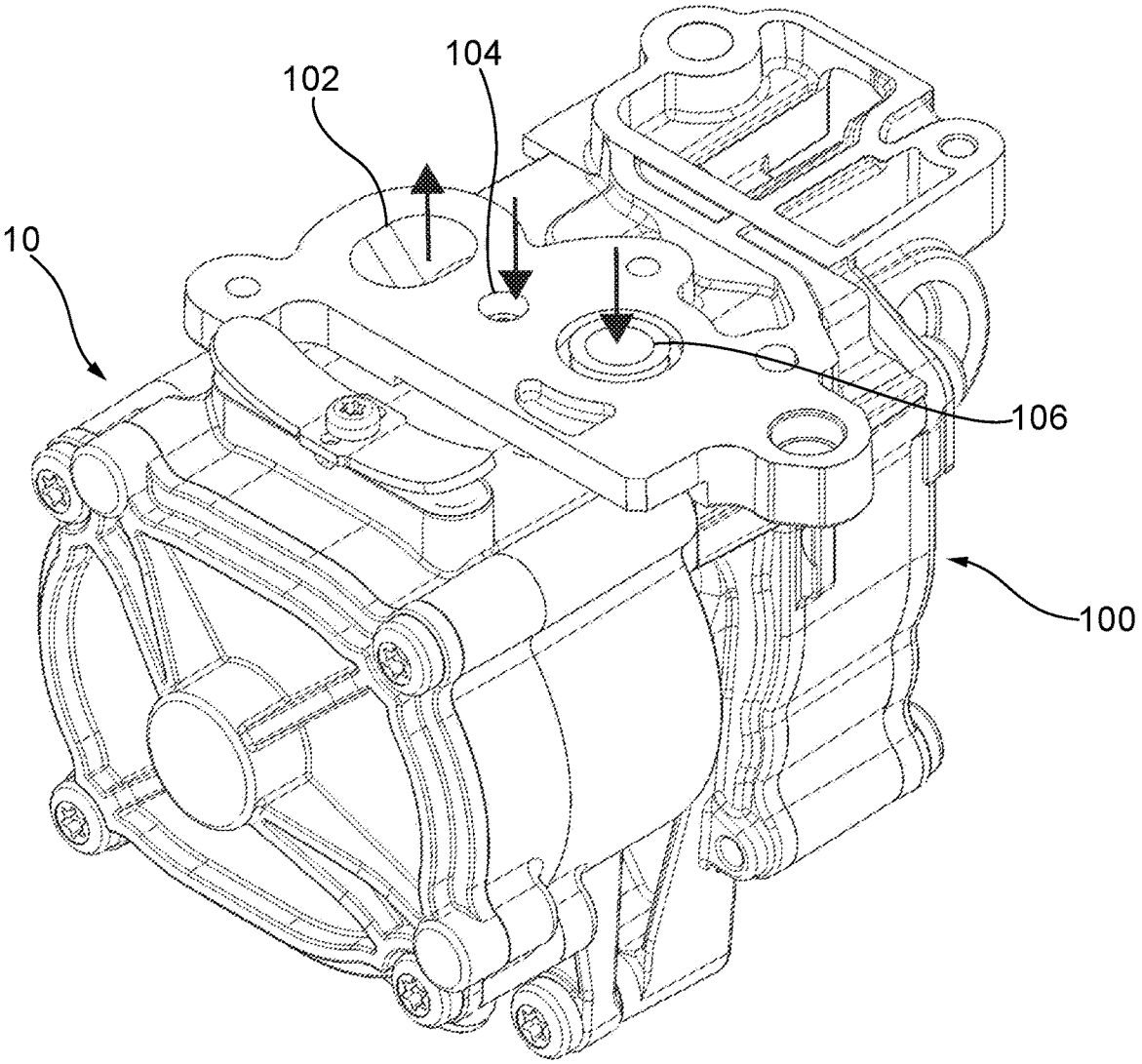
FIG. 47 is a isometric view of a vacuum pump in accordance with an embodiment of this disclosure connected in tandem to an oil pump.

The embodiments and any variants of the invention may be applied to engines, and particularly vehicle engines, such as for automobiles, trucks, etc. Other applications are also possible. In the engine context, the single inlet for drawing lubricant allows easy connection to the oil gallery of an engine or an outlet of an oil pump. In some embodiments, the vacuum pump may be packaged together with an oil pump as a tandem unit with each driven by the same power take-off (e.g., a pulley or sprocket driven by a belt or chain driven by the engine). For example, FIG. 47 shows an exemplary embodiment in accordance with this disclosure of connecting a vacuum pump—e.g., vacuum pump 10 as shown in FIGS. 1-31—directly in tandem to an oil pump 100. They may be connected, for example, via aligning openings on the housing 12 of the vacuum pump 10 with corresponding openings on the housing of the oil pump, and secured using bolts. As shown in FIG. 47, a manifold may be provided on top of the connected pumps that includes an oil pump outlet 102, a port or an opening 104 for oil feedback from the engine gallery, and a vacuum pump inlet 106. The arrows indicate the fluid (air or lubricant or oil) movement in relation to the manifold and connected pumps. Pressurized lubricant or oil from the oil pump 100 may be directed from an outlet in its housing through outlet 102 and to device for lubrication (e.g., transmission or engine). Pressurized lubricant or oil from the engine gallery may be fed into the feedback opening 104 such that the lubricant may be drawn into the vacuum pump 10, via the pressure differential, into its opening 61A, inlet 60A, and channels 60, 56, and 58, for example. Vacuum pump inlet 106 is fluidly connected to the chamber inlet(s) 64, 66 of the vacuum pump 10 (for drawing air into the housing). Using the epitrochoidal design where the oil pump and vacuum pump are driven together by the same input allows the oil pump to be driven at a high speed, while the rotor in the vacuum pump is geared down by its epitrochoidal design factor (e.g., rotor speed is reduced by 50% from the drive speed for a two lobe design, or reduced by 66% from the drive speed for a three lobe design). The oil pump and vacuum pump may share a common drive shaft, or simply be connected to have their inputs share the same rotational input. The difference in drive ratios enables a convenient installation with the drive ratios of both pumps managed respectively by their own internal designs. In some embodiments, the lubricant input for the vacuum pump may be connected directly to an outlet of the oil pump on the high pressure side thereof to avoid the need to make a separate connection between the vacuum pump lubricant inlet and the engine gallery.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. An epitrochoidal vacuum pump comprising:

a housing comprising a chamber having an internal space defined by a surrounding wall flanked by a front wall and a back wall, the internal space having an epitrochoidal shape;

a rotor rotatably received within the internal space of the chamber, the rotor being shaped with a number of edges that conjugate with the epitrochoidal shape of the internal space and comprising an internally toothed guide gear;

a drive shaft configured to rotate the rotor eccentrically about an axis within the chamber;

an externally toothed guide sprocket for meshing with and guiding movement of the internally toothed guide gear of the rotor as it is driven by the drive shaft;

a first chamber inlet and a second chamber inlet for drawing air under negative pressure into the housing, the first chamber inlet and the second chamber inlet being fluidly connected via at least one inlet channel provided in the housing;

a first outlet and a second outlet for expulsing air under positive pressure from the housing; and a fluid inlet for inputting lubricant, the fluid inlet being communicated to both a drive shaft channel for leading the lubricant to the drive shaft for lubrication thereof and a chamber channel for leading the lubricant to the internal space of the housing chamber, the drive shaft channel and the chamber channel being subject to a pressure differential generated in the internal space for drawing the lubricant through the fluid inlet and both of said drive shaft channel and said chamber channel, wherein the drive shaft channel and the chamber channel connect to one another directly at a junction and the fluid inlet is configured to deliver the lubricant to said junction to feed the lubricant to both said drive shaft channel and the chamber channel, and wherein the chamber channel fluidly connects to two radial channels extending radially outwardly along an interior wall of the housing to the first and second chamber inlets.

2. The epitrochoidal vacuum pump of claim 1, wherein the drive shaft channel and the chamber channel are provided in the back wall.

3. The epitrochoidal vacuum pump of claim 2, wherein the drive shaft channel is formed in the housing to extend from the fluid inlet to an opening receiving the drive shaft, and wherein the chamber channel is formed in the housing to extend from the junction to the internal space of the chamber.

4. The epitrochoidal vacuum pump of claim 1, wherein the drive shaft channel extends radially through the back wall of the housing for drawing the lubricant to the drive shaft.

5. The epitrochoidal vacuum pump of claim 1, wherein the chamber channel extends axially through the back wall of the housing for drawing the lubricant to the internal space the housing chamber.

6. The epitrochoidal vacuum pump of claim 1, wherein the drive shaft channel is formed in the housing to extend from the fluid inlet to an opening receiving the drive shaft, and wherein the chamber channel is formed in the housing to extend from the opening to the internal space of the chamber.

7. The epitrochoidal vacuum pump of claim 1, wherein the guide sprocket is secured to the front wall.

8. The epitrochoidal vacuum pump of claim 1, wherein the surrounding wall forms a substantially ovular space within the housing and wherein the rotor has three, bow shaped outer edges.

9. The epitrochoidal vacuum pump of claim 1, further comprising a first air passageway and a second air passageway for intaking air, wherein the first air passageway delivers the air to the first chamber inlet and the second air passageway delivers said air to the second chamber inlet.

10. The epitrochoidal vacuum pump of claim 1, wherein a reed valve is positioned on the housing adjacent to the first outlet and/or the second outlet.

11. The epitrochoidal vacuum pump of claim 1, further comprising an eccentric rotation bearing positioned between and connecting the drive shaft and the rotor.

* * * * *